US011648176B2

(12) United States Patent
Marshall et al.

(10) Patent No.: US 11,648,176 B2
(45) Date of Patent: May 16, 2023

(54) MEDICINE CONTAINER, METHOD OF ASSEMBLING THE CONTAINER, AND METHOD OF DISPENSING THE MEDICINE FROM THE CONTAINER

(71) Applicant: AbbVie Inc., North Chicago, IL (US)

(72) Inventors: Todd Marshall, Lindenhurst, IL (US); Bhimaprasad Medhal, Lake Forest, IL (US); John G. Finch, Vernon Hills, IL (US); Joy Elizabeth Borgardt, Evanston, IL (US)

(73) Assignee: ABBVIE INC., North Chicago, IL (US)

( * ) Notice: Subject to any disclaimer, the term of this patent is extended or adjusted under 35 U.S.C. 154(b) by 71 days.

(21) Appl. No.: 17/319,917

(22) Filed: May 13, 2021

(65) Prior Publication Data

US 2022/0008290 A1 Jan. 13, 2022

Related U.S. Application Data

(63) Continuation of application No. 15/928,943, filed on Mar. 22, 2018, now Pat. No. 11,052,021.

(51) Int. Cl.
*A61J 1/03* (2023.01)
*B65D 75/36* (2006.01)
(Continued)

(52) U.S. Cl.
CPC ..... *A61J 1/035* (2013.01); *A61J 7/04* (2013.01); *B65D 75/367* (2013.01); *B65D 75/54* (2013.01);
(Continued)

(58) Field of Classification Search
CPC ..... A61J 1/035; A61J 7/04; B65D 75/367; B65D 75/54; B65D 77/042
(Continued)

(56) References Cited

U.S. PATENT DOCUMENTS

D97,936 S 12/1935 Neumann-Holste
3,288,281 A 11/1966 Sparks
(Continued)

FOREIGN PATENT DOCUMENTS

AU 314244 S 5/2007
AU 341384 S 3/2012
(Continued)

OTHER PUBLICATIONS

PCT International Search Report and Written Opinion, Application No. PCT/US2019/022853, dated Jul. 2, 2019, 15 pages.

*Primary Examiner* — Anthony D Stashick
*Assistant Examiner* — L Kmet
(74) *Attorney, Agent, or Firm* — Armstrong Teasdale LLP

(57) ABSTRACT

A child-resistant medication container assembly that includes a blister card including a plurality of compartments each configured to support a dosage of medication, and a puck including a body portion, a recess that defines a partition wall in the body portion, and a plurality of openings defined in the partition wall. Each opening corresponds to one of the plurality of compartments in the blister card. The assembly further includes a carton including a first wall opposite a second wall. An access opening is defined in the first wall and a plurality of perforations are defined in the second wall. The access opening is sized to provide access to the plurality of compartments, and each perforation corresponds to one of the plurality of compartments in the blister card.

20 Claims, 21 Drawing Sheets

(51) Int. Cl.
*B65D 75/54* (2006.01)
*B65D 77/04* (2006.01)
*B65D 83/04* (2006.01)
*A61J 7/04* (2006.01)

(52) U.S. Cl.
CPC ..... *B65D 77/042* (2013.01); *B65D 83/0463* (2013.01); *A61J 2205/20* (2013.01); *A61J 2205/30* (2013.01); *B65D 2215/00* (2013.01)

(58) Field of Classification Search
USPC ..... 206/532
See application file for complete search history.

(56) References Cited

U.S. PATENT DOCUMENTS 3,305,077 A 2/1967 Martin et al.
3,911,606 A 10/1975 Hunkins
3,921,804 A 11/1975 Tester
RE29,705 E 7/1978 Compere
4,120,400 A 10/1978 Kotyuk
D254,219 S 2/1980 Papciak
4,192,422 A 3/1980 Kotyuk
D261,198 S 10/1981 Altadonna
D263,559 S 3/1982 Poore
D264,538 S 5/1982 Pomroy
4,340,141 A 7/1982 Fischer
D266,147 S 9/1982 Mcintosh et al.
D267,767 S 2/1983 Storrs
D268,130 S 3/1983 Easton
D276,116 S 10/1984 Basil
D293,887 S 1/1988 Webster
4,838,444 A 6/1989 Bitel
5,050,739 A 9/1991 Hannan et al.
D320,930 S 10/1991 Richards
D322,400 S 12/1991 Sorensen
D322,934 S 1/1992 Kalvelage
D324,819 S 3/1992 Eisenberg
5,109,984 A 5/1992 Romick
D327,363 S 6/1992 Farb
D331,258 S 11/1992 Tarozzi
D350,478 S 9/1994 Fuller et al.
D351,995 S 11/1994 Kalvelage
D351,996 S 11/1994 Kalvelage
5,489,025 A 2/1996 Romick
D370,414 S 6/1996 Lambelet
D370,625 S 6/1996 Kelsey et al.
D372,124 S 7/1996 Dammers
D372,867 S 8/1996 Lambelet
D382,474 S 8/1997 Malmborg
5,740,717 A 4/1998 Sowden et al.
5,785,180 A 7/1998 Dressel et al.
D404,641 S 1/1999 Kelsey et al.
5,878,888 A 3/1999 Faughey et al.
D411,445 S 6/1999 Anderson
D414,106 S 9/1999 Anderson
D414,409 S 9/1999 Sanfilippo et al.
6,082,544 A 7/2000 Romick
6,138,830 A 10/2000 Muggli
D434,558 S 12/2000 Brady et al.
6,273,260 B1 8/2001 Coldepietro et al.
D448,048 S 9/2001 Brown
D457,246 S 5/2002 Mazel et al.
6,443,307 B1 9/2002 Burridge
6,516,949 B2 2/2003 Fuller et al.
6,622,856 B2 9/2003 Gallo et al.
D480,958 S 10/2003 Mazel et al.
6,659,280 B2 12/2003 Paliotta et al.
6,679,382 B1 1/2004 Kancsar et al.
D485,979 S 2/2004 Chue
6,793,077 B1 9/2004 Kancsar et al.
6,896,139 B2 5/2005 Kancsar et al.
6,951,282 B2 10/2005 Jones
D514,308 S 2/2006 Wahl et al.
6,997,320 B1 2/2006 Kancsar et al.
D518,737 S 4/2006 Zalzal
7,063,211 B2 6/2006 Williams-Hartman
D525,024 S 7/2006 Fridie et al.
D525,777 S 8/2006 Priebe et al.
D526,478 S 8/2006 Priebe et al.
7,126,879 B2 10/2006 Snyder
7,188,728 B2 3/2007 Williams-Hartman
D546,198 S 7/2007 Currie et al.
7,243,798 B2 7/2007 Buss
D558,603 S 1/2008 Priebe et al.
7,360,652 B2 4/2008 Arnold
D570,095 S 6/2008 Ullersted et al.
7,401,702 B2 7/2008 Hession
D574,665 S 8/2008 James
7,448,496 B2 11/2008 Williams-Hartman
7,497,331 B2 3/2009 Pham
D600,503 S 9/2009 Ragsdale et al.
7,641,050 B2 1/2010 Klatt et al.
7,665,610 B2 2/2010 Williams-Hartman
D612,594 S 3/2010 Wade et al.
D613,153 S 4/2010 Russell
7,696,236 B2 4/2010 Bradford
7,699,173 B2 4/2010 Hession
7,735,650 B2 6/2010 Zumbiel
D619,257 S 7/2010 Meschenmoser et al.
D620,260 S 7/2010 Emmert
7,748,535 B2 7/2010 Grosskopf
D621,151 S 8/2010 Richardson
D622,158 S 8/2010 Proulx
7,767,700 B2 8/2010 Bradford
7,780,007 B2 8/2010 Baker
7,784,250 B2 8/2010 Grosskopf
7,891,492 B2 2/2011 Wenninger et al.
7,900,772 B2 3/2011 Sack et al.
7,905,355 B2 3/2011 Williams-Hartman
7,926,660 B2 4/2011 Jones et al.
D637,391 S 5/2011 Stevens et al.
7,967,144 B2 6/2011 Sack et al.
D642,789 S 8/2011 Cooper
7,997,411 B2 8/2011 Williams-Hartman
8,011,512 B2 9/2011 Brollier et al.
D650,295 S 12/2011 Schmitz et al.
8,091,708 B2 1/2012 Loftin et al.
8,132,671 B2 3/2012 Hession
D658,991 S 5/2012 Schmitz et al.
D659,019 S 5/2012 Specker et al.
D659,550 S 5/2012 Mazor
8,205,752 B2 6/2012 Sack et al.
D663,981 S 7/2012 Purcell et al.
D669,311 S 10/2012 Hsu
D670,178 S 11/2012 Carson
8,317,017 B2 11/2012 Edwards et al.
D673,297 S 12/2012 Hawker
8,342,330 B2 1/2013 Weston et al.
8,342,331 B2 1/2013 Ziemba et al.
8,403,212 B2 3/2013 Van Esch
D680,318 S 4/2013 Denzinger
8,413,813 B2 4/2013 Grosskopf
8,420,674 B2 4/2013 Bradford
D683,950 S 6/2013 Ernster et al.
D684,482 S 6/2013 Stevens
D685,272 S 7/2013 Stevens
8,479,921 B2 7/2013 Ingraham
D688,570 S 8/2013 Logue
D688,571 S 8/2013 Logue
8,499,531 B2 8/2013 Benetti et al.
D689,373 S 9/2013 Logue
D689,374 S 9/2013 Logue
D689,778 S 9/2013 Logue
D691,465 S 10/2013 O'Brien et al.
D691,856 S 10/2013 Dabney-Wiggs
8,544,650 B2 10/2013 Williams-Hartman
8,550,248 B1 10/2013 Busen
8,556,077 B1 10/2013 Hanley
8,561,798 B2 10/2013 Hession
8,567,606 B2 10/2013 Bellamah et al.
8,573,403 B2 11/2013 Stevens et al.
8,579,106 B2 11/2013 Naik et al.
8,584,857 B2 11/2013 Ozawa et al.

(56) References Cited

U.S. PATENT DOCUMENTS

| | | | | |
|---|---|---|---|---|
| D694,904 | S | 12/2013 | Banes et al. | |
| 8,602,218 | B2 | 12/2013 | Grosskopf | |
| 8,607,982 | B2 | 12/2013 | Jones | |
| 8,607,983 | B2 | 12/2013 | Niven et al. | |
| D697,095 | S | 1/2014 | Chan | |
| 8,627,957 | B2 | 1/2014 | Ziemba et al. | |
| 8,640,917 | B2 | 2/2014 | Kracke | |
| D700,773 | S | 3/2014 | Lupkas | |
| 8,672,134 | B2 | 3/2014 | Sprada et al. | |
| 8,740,003 | B2 | 6/2014 | Elliott | |
| 8,746,454 | B2 | 6/2014 | Doucet et al. | |
| 8,752,704 | B2 * | 6/2014 | Leon Alonso | B65D 75/327 206/532 |
| 8,757,381 | B2 | 6/2014 | Bouthiette | |
| D708,760 | S | 7/2014 | Smeja | |
| D708,761 | S | 7/2014 | Smeja | |
| D708,762 | S | 7/2014 | Smeja | |
| D711,219 | S | 8/2014 | Palsson | |
| D713,051 | S | 9/2014 | Smeja | |
| D719,216 | S | 12/2014 | Jansen et al. | |
| D723,279 | S | 3/2015 | Wax | |
| D723,390 | S | 3/2015 | Eriksson et al. | |
| 8,991,607 | B2 | 3/2015 | Wagner et al. | |
| D731,171 | S | 6/2015 | Upchurch et al. | |
| D731,782 | S | 6/2015 | Upchurch et al. | |
| 9,241,873 | B2 * | 1/2016 | Upchurch | A61J 7/0076 |
| 9,408,777 | B2 * | 8/2016 | Choubey | B65D 75/327 |
| D770,303 | S | 11/2016 | Gelbaum | |
| D772,559 | S | 11/2016 | Binder et al. | |
| D787,812 | S | 5/2017 | Ganesan et al. | |
| D806,570 | S | 1/2018 | Gelbaum | |
| D831,330 | S | 10/2018 | Kim et al. | |
| D833,734 | S | 11/2018 | Binder et al. | |
| D874,921 | S | 2/2020 | Zhao | |
| D876,819 | S | 3/2020 | Kim et al. | |
| D877,625 | S | 3/2020 | Loprete et al. | |
| D882,243 | S | 4/2020 | Marshall et al. | |
| D896,068 | S | 9/2020 | Hampton et al. | |
| 2003/0034271 | A1 | 2/2003 | Burridge | |
| 2003/0042167 | A1 | 3/2003 | Balz et al. | |
| 2003/0164380 | A1 | 9/2003 | Taneja et al. | |
| 2006/0163110 | A1 | 7/2006 | Adler et al. | |
| 2007/0185615 | A1 | 8/2007 | Bossi et al. | |
| 2009/0038982 | A1 * | 2/2009 | Doucet | B65D 83/0463 206/531 |
| 2009/0242451 | A1 | 10/2009 | Kessler | |
| 2009/0301924 | A1 | 12/2009 | Rondeau | |
| 2011/0215022 | A1 | 9/2011 | Sack et al. | |
| 2012/0248005 | A1 | 10/2012 | Bergey | |
| 2012/0261275 | A1 | 10/2012 | Intini | |
| 2013/0008825 | A1 | 1/2013 | Mcarthur et al. | |
| 2013/0193029 | A1 | 8/2013 | Weston et al. | |
| 2013/0220870 | A1 | 8/2013 | Grosskopf | |
| 2013/0220871 | A1 | 8/2013 | Bradford | |
| 2013/0233756 | A1 | 9/2013 | Weston et al. | |
| 2013/0256183 | A1 | 10/2013 | Ingraham | |
| 2013/0281960 | A1 | 10/2013 | Hanley | |
| 2013/0306511 | A1 | 11/2013 | Branyon et al. | |
| 2014/0001194 | A1 | 1/2014 | Pipes et al. | |
| 2014/0027340 | A1 | 1/2014 | Hession | |
| 2014/0027341 | A1 | 1/2014 | Ludwig et al. | |
| 2014/0083900 | A1 | 3/2014 | Ziemba et al. | |
| 2014/0171436 | A1 | 6/2014 | Kamen et al. | |
| 2014/0183095 | A1 | 7/2014 | Choubey et al. | |
| 2014/0209498 | A1 | 7/2014 | Stevens | |
| 2014/0214438 | A1 | 7/2014 | Ahmadi | |
| 2014/0216968 | A1 | 8/2014 | Wagner et al. | |
| 2014/0216977 | A1 | 8/2014 | Bowers et al. | |
| 2015/0014203 | A1 | 1/2015 | Upchurch et al. | |
| 2016/0367436 | A1 | 12/2016 | Upchurch et al. | |
| 2017/0014306 | A1 | 1/2017 | Rousselet | |
| 2017/0107038 | A1 | 4/2017 | Kim et al. | |
| 2017/0112719 | A1 | 4/2017 | O'Dwyer et al. | |
| 2017/0239144 | A1 | 8/2017 | Terhune et al. | |
| 2018/0000691 | A1 | 1/2018 | Terhune et al. | |
| 2019/0290542 | A1 | 9/2019 | Marshall et al. | |

FOREIGN PATENT DOCUMENTS

| | | | |
|---|---|---|---|
| AU | 346153 | S | 1/2013 |
| AU | 348282 | S | 5/2013 |
| AU | 357121 | S | 8/2014 |
| AU | 359486 | S | 12/2014 |
| CA | 114356 | S | 3/2008 |
| CA | 120646 | S | 3/2008 |
| EP | 1211191 | A1 | 6/2002 |
| EP | 1481914 | A1 | 12/2004 |
| EP | 3016886 | A1 | 5/2016 |
| JP | 2003221067 | A | 8/2003 |
| WO | 2005120984 | A1 | 12/2005 |
| WO | 2010015638 | A1 | 2/2010 |
| WO | 2014057967 | A1 | 4/2014 |
| WO | 2014085625 | A1 | 6/2014 |

* cited by examiner

MEDICINE CONTAINER, METHOD OF ASSEMBLING THE CONTAINER, AND METHOD OF DISPENSING THE MEDICINE FROM THE CONTAINER

CROSS-REFERENCE TO RELATED APPLICATION

This application is a continuation application and claims priority to U.S. patent application Ser. No. 15/928,943, filed Mar. 22, 2018, entitled "MEDICINE CONTAINER, METHOD OF ASSEMBLING THE CONTAINER, AND METHOD OF DISPENSING THE MEDICINE FROM THE CONTAINER," which is incorporated by reference in its entirety.

BACKGROUND

The field of the present disclosure relates generally to medication packaging and, more specifically, to a child-resistant medication container assembly for storing a plurality of dosages of medication therein, for dispensing the dosages from the container, and for providing information related to administration of the medication integrated with the container assembly.

To receive prescription medicines, patients need to acquire a prescription prepared by a person authorized to prescribe medicine. A prescription medicine is then dispensed by a pharmacist, and the prescription medicine typically comes with an information leaflet providing information about the medicine, its side effects, if any, instructions for use of the medicine, and any relevant cautions and warnings.

Most prescription medicines are dispensed by a pharmacist in a bottle or in a blister card. Some prescription medicines that are dispensed in this manner have complicated instructions for use and may not be easy for a patient to remember. For example, some prescription medicines are to be taken in the morning, afternoon, or evening, some with or without food, some with or without certain types of food, and in particular quantities. In these situations, a patient may need to read the bottle, or compliance pack, or refer back to the information leaflet for instructions when taking the medicine. A patient also may need to keep a log of when he or she took the medicine to ensure compliance with any timing instructions.

BRIEF DESCRIPTION

In one aspect, a child-resistant medication container assembly is provided. The assembly includes a blister card including a plurality of compartments each configured to support a dosage of medication, and a puck including a body portion, a recess that defines a partition wall in the body portion, and a plurality of openings defined in the partition wall. Each opening corresponds to one of the plurality of compartments in the blister card. The assembly further includes a carton including a first wall opposite a second wall. An access opening is defined in the first wall and a plurality of perforations are defined in the second wall. The access opening is sized to provide access to the plurality of compartments, and each perforation corresponds to one of the plurality of compartments in the blister card.

In another aspect, a method of assembling a child-resistant medication container assembly is provided. The method includes aligning a blister card, including a plurality of compartments each configured to support a dosage of medication, with a puck that includes a body portion, a recess that defines a partition wall in the body portion, and a plurality of openings defined in the partition wall. Each opening corresponds to one of the plurality of compartments in the blister card when the blister card is aligned with the puck. The method further includes attaching the blister card to the puck to form a puck assembly, and positioning the puck assembly within a carton that includes a first wall opposite a second wall. An access opening is defined in the first wall and a plurality of perforations are defined in the second wall. The access opening is sized to provide access to the plurality of compartments, and each perforation corresponds to one of the plurality of compartments in the blister card. The method also includes closing the carton to enclose the puck assembly therein.

In yet another aspect, a method of dispensing medication secured within a child-resistant medication container assembly to a user is provided. The method includes providing the child-resistant medication container assembly including a carton, a puck, and a blister card, wherein the blister card is secured to the puck and the puck is secured to the carton. The method further includes applying a force to at least one compartment of a plurality of compartments of the blister card, wherein the plurality of compartments are accessible through an access opening in a first wall of the carton, and breaking a seal of the at least one compartment such that a dosage of medication contained therein is discharged through an opening in the puck and through an opening in a second wall of the carton. The opening in the second wall of the carton is defined by a perforation in the second wall.

DETAILED DESCRIPTION

Figure 1:
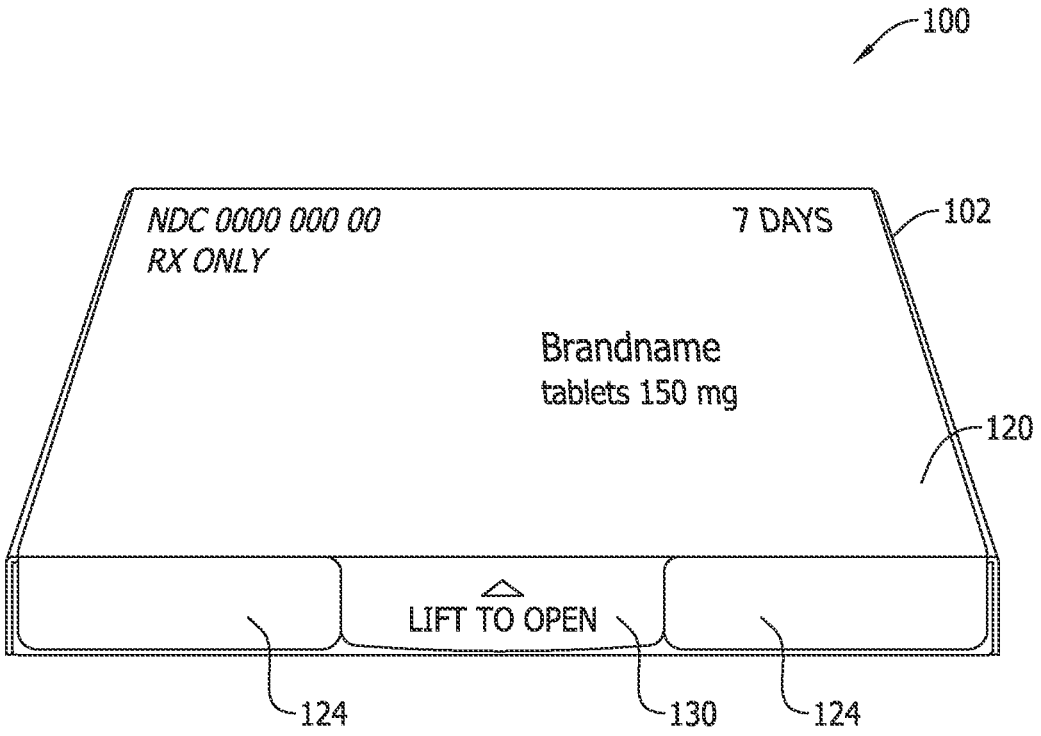
FIG. 1 is a perspective view of an example child-resistant medication container assembly, the container assembly having a cover in a closed position.

The following detailed description illustrates the disclosure by way of example and not by way of limitation. The description enables one skilled in the art to make and use the disclosure, describes several embodiments, adaptations, variations, alternatives, and use of the disclosure, including what is presently believed to be the best mode of carrying out the disclosure.

Embodiments of the present disclosure relate to a child-resistant medication container assembly for storing a plurality of dosages of medication therein, for dispensing the dosages from the container, and for providing information related to administration of the medication integrated with the container assembly. The container assembly includes a carton and a puck assembly positioned within the carton. The puck assembly is formed from a puck that is rigid and capable of supporting a blister card having a plurality of compartments. Each compartment is sized to store a dosage of medication therein. When a consumer is ready to access the dosage of medication in one of the compartments, the consumer opens the carton to gain access to the puck assembly. For example, in one embodiment, the carton includes a first wall having an access opening defined therein, and a second wall having a plurality of perforations defined therein. Each perforation corresponds to one of the compartments in the blister card. Thus, the consumer accesses the plurality of compartments through the access opening, applies a force to the desired compartment, breaks a seal in the blister card that covers the desired compartment, and then forces the dosage through the corresponding perforation in the second wall of the carton to dispense the dosage of medication from the container assembly. As used herein, the term "user" or "consumer" means a person or person(s) who is consuming or using contents from the container assembly (e.g. a patient), a healthcare provider, and/or a patient assistant providing the contents from the container to the person(s) consuming the contents from the container. As used herein, the term "puck" is a term used by those skilled in the art, and generally refers to an object having a rigid body that substantially maintains its shape when a manual force is applied thereto.

The access opening is sized larger than an individual compartment in the blister card such that the first wall of the carton does not act as either a visual or physical hindrance to applying a force to the compartment with the user's finger when dispensing the dosage of medication from the container assembly. Moreover, no portion of the first wall extends across the access opening, thereby reducing the likelihood that the first wall will become damaged when attempting to access the plurality of compartments through the access opening. A damaged first wall may reduce the aesthetic appearance of the carton, and/or may act as an impediment to closing the cover of the carton when not in use.

In one embodiment, the container assembly is configured to be conveniently sized and portable, but also large enough to carry a sufficient amount of dosages to sustain the user for an extended period of time. For example, the carton has a generally thin profile such that it is capable of being placed within a pocket or a handbag of the user. As such, the user has the ability to carry the container assembly with them and administer a dosage of medication whenever it is convenient to do so. Moreover, as noted above, the blister card includes a plurality of compartments such that a user need only carry as many container assemblies as needed (e.g., one per week, or more than one if traveling for extended durations) rather than an entire prescription's worth of medication.

As noted above, the container assembly also includes information related to administration of the medication integrated with the carton. For example, in one embodiment, the blister card includes a number of compartments that is a multiple of the number of days in a week (e.g., 7, 14, or 21 compartments), and each compartment, or groupings of compartments, are labeled according to respective days of the week. In one embodiment, the container assembly also includes an informational panel adhered to a cover of the carton that overlays the first wall when in a closed position. The informational panel is positioned such that when the cover is in an open position, the user is provided with access to the plurality of compartments of the blister card and is also provided with a view of the instructional panel simultaneously. As such, the container assembly includes information that is conveniently located, easily discernible, and difficult to miss.

In one embodiment, the container assembly, an overpack carton, and/or blanks for forming the container assembly or the overpack carton, may include at least one marking thereon including, without limitation, indicia that communicates the product, a manufacturer of the product, and/or a seller of the product. For example, the marking may include printed text that indicates a product's name and briefly describes the product, logos and/or trademarks that indicate a manufacturer and/or seller of the product, and/or designs and/or ornamentation that attract attention. In another embodiment, the container assembly is void of markings, such as, without limitation, indicia that communicates the product, a manufacturer of the product, and/or a seller of the product. Furthermore, the container assembly and/or overpack carton may have any suitable size, shape, and/or configuration (i.e., number of sides), whether such sizes, shapes, and/or configurations are described and/or illustrated herein. For example, in one embodiment, the container assembly includes a shape that provides functionality, such as a shape that enables the container assembly to be easily transportable during every day use.

Figure 2:
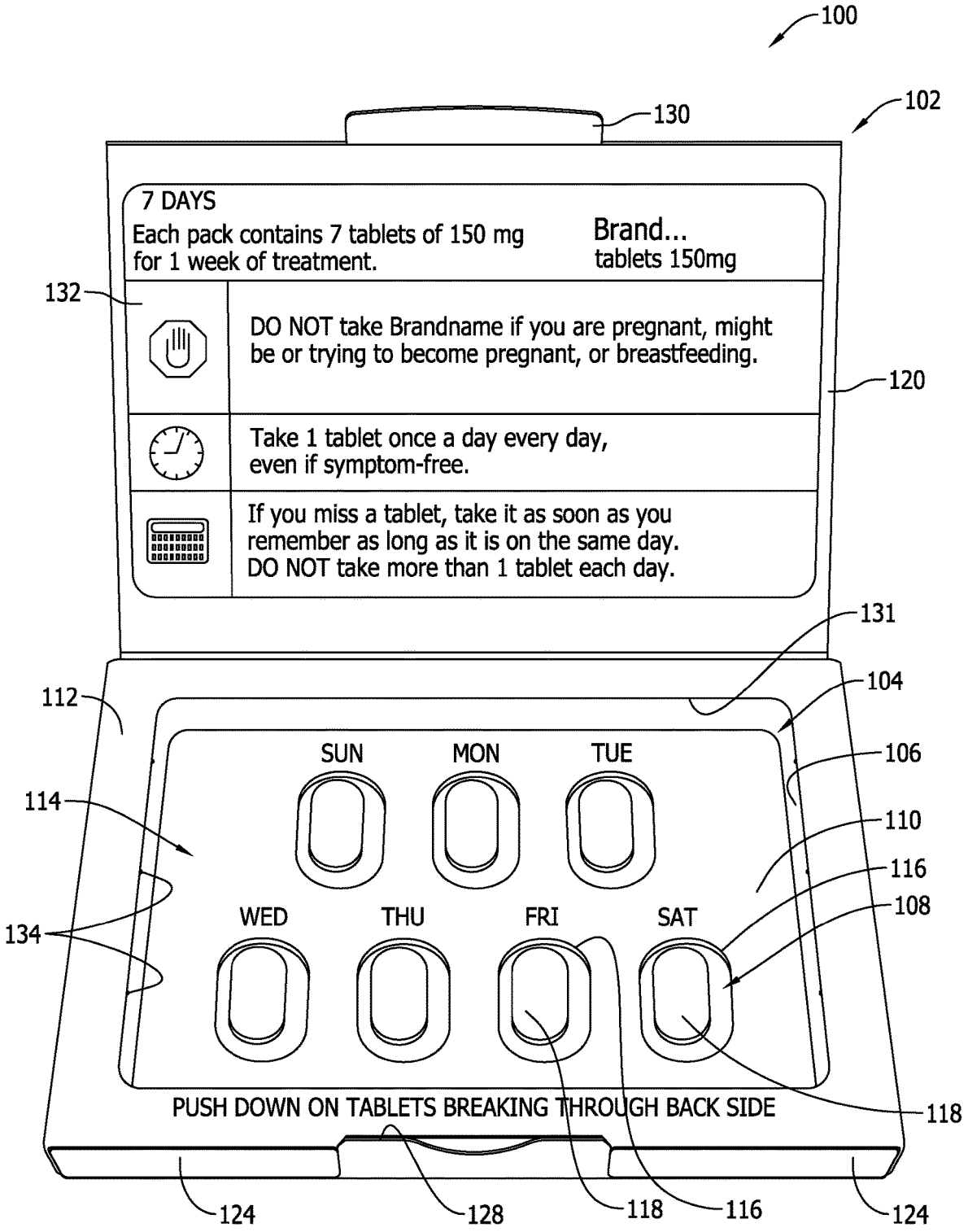
FIG. 2 is a perspective view of the child-resistant medication container assembly shown in FIG. 1 with the cover in an open position.

Referring now to the drawings, FIGS. 1 and 2 are perspective views of an example child-resistant medication container assembly 100. In the example embodiment, container assembly 100 includes a carton 102 and a puck assembly 104 positioned within carton 102. Puck assembly 104 is formed from a puck 106, a blister card 108, and a label insert 110, as will be explained in more detail below. Carton 102 includes a first wall 112 having an access opening 114 defined therein. Access opening 114 is sized to provide access to puck assembly 104 and, more specifically, to a plurality of compartments 116 of blister card 108 that are each configured to support a dosage 118 of medication.

Carton 102 also includes a second wall 182 (shown in FIG. 8) and a third wall 120 that selectively overlays first wall 112. For example, referring to FIG. 1, third wall 120 is in a closed position, which restricts access to puck assembly 104 through access opening 114. In the example embodiment, third wall 120 is initially secured to the remainder of carton 102 in the closed position with adhesive. More specifically, carton 102 includes a first side wall 180 extending from first wall 112, and a pair of breakaway tabs 124 extending from third wall 120. When in the initially secured state, the pair of breakaway tabs 124 are adhered to first side wall 180, and the pair of breakaway tabs 124 are coupled to third wall 120 with at least one connector tab 126 (shown in FIGS. 8-9), such as a single connector tab 126 or multiple connector tabs 126.

Referring to FIG. 2, third wall 120 is rotatable relative to first wall 112 such that third wall 120 is positioned in an open position to provide access to access opening 114. More specifically, when opening container assembly 100 from its initially secured state shown in FIG. 1, a consumer breaks the at least one connector tab 126 formed between each breakaway tab 124 and third wall 120, such as by rotating third wall 120 relative to first wall 112. As such, the pair of breakaway tabs 124 remain adhered to first side wall 180, and third wall 120 becomes freely rotatable relative to first wall 112. In the example embodiment, carton 102 further includes a securing tab 130 extending from third wall 120, and a tab slot 128 defined between first wall 112 and first side wall 180. As such, third wall 120 may be re-secured in the closed position by inserting securing tab 130 within tab slot 128.

In the example embodiment, access opening 114 is sized to correspond to an upper perimeter of a recess of puck 106, as will be explained in more detail below. In other words, access opening 114 is sized such that an inner side edge 131 of access opening 114 does not extend past the upper perimeter edge of the recess of puck 106. In one embodiment, inner side edge 131 defines a frame about the plurality of compartments 116. In addition, access opening 114 is sized such that the plurality of compartments 116 are accessible through access opening 114 simultaneously. For example, access opening 114 is free of impediments, and does not have a portion of first wall 112 extending thereaross such that more than one compartment 116 is accessible through access opening 114 without manipulating the shape of carton 102 or of puck 106.

In one embodiment, carton 102 also includes a removable panel 132 adhered to third wall 120. Removable panel 132 is initially secured to first wall 112 when third wall 120 is in the closed position and container assembly 100 is in its initially secured state. More specifically, removable panel 132 is initially secured to first wall 112 with a plurality of connector tabs 134 disposed about a periphery of access opening 114. The plurality of connector tabs 134 are broken when third wall 120 is rotated from the closed position, as shown in FIG. 1, to the open position. As such, removable panel 132 is oriented to face the consumer when third wall 120 is in the open position. Accordingly, in the example embodiment, removable panel 132 includes information related to administration of the medication printed thereon. For example, the information can include, but is not limited to, dosage size of the medication contained in container assembly 100, warning notices, administration instructions such as the frequency in which the medication should be taken, and symbols that facilitate enhancing the discernibility of the information contained on removable panel 132.

Referring to FIGS. 3-6, and as noted above, puck assembly 104 is formed from puck 106, blister card 108, and label insert 110. In the example embodiment, puck 106 includes a body portion 136 having a first side 138 and a second side 140. A recess 142 is defined in first side 138, and recess 142 defines side walls 144 of puck 106. Recess 142 is also partially defined by a partition wall 146 in body portion 136, and a plurality of openings 148 are defined in partition wall 146. Each opening 148 corresponds to one of the plurality of compartments 116 in blister card 108 such that openings 148 in puck 106 are configured to align with compartments 116 of blister card 108 having a specific and predetermined orientation. For example, as noted above, the number of compartments 116 in blister card 108 is a multiple of the number of days in the week. As such, puck 106 includes the same number of openings 148 as the number of compartments 116 in blister card 108 such that each compartment 116 is inserted through a respective corresponding opening 148 when puck 106 and blister card 108 are aligned with each other. In some embodiments, blister card 108 is adhered to second side 140 of puck 106.

Figure 4:
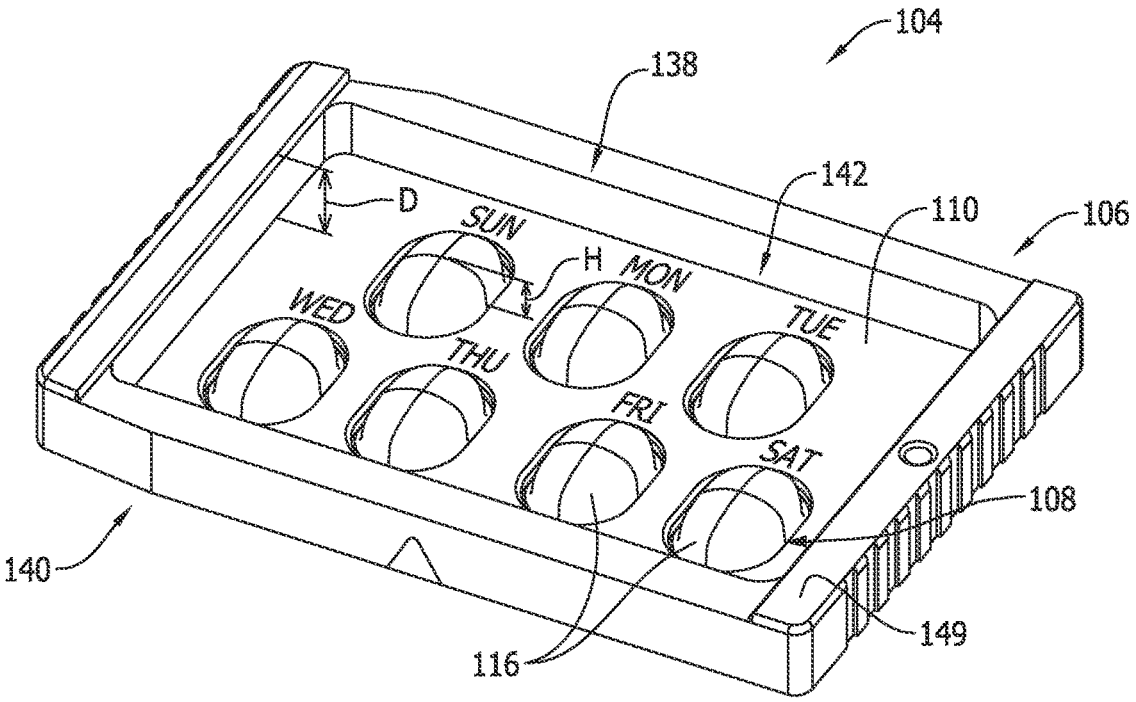
FIG. 4 is an assembled view of the puck assembly shown in FIG. 3.
Figure 5:
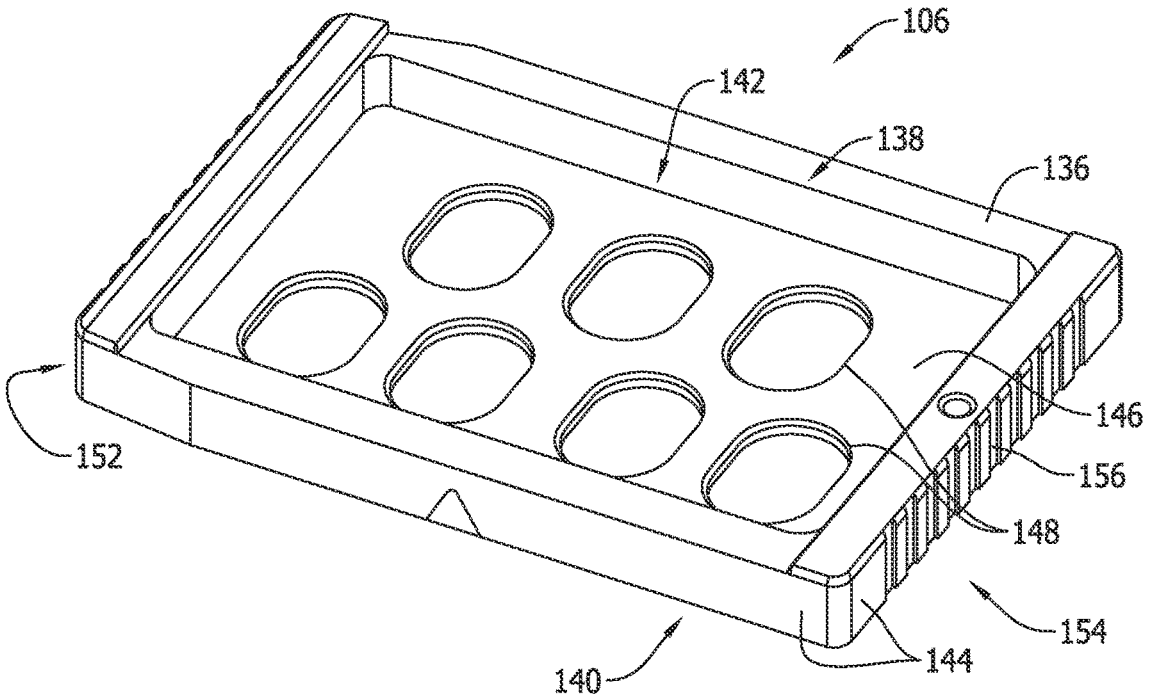
FIG. 5 is a perspective view of a first side of an example puck that may be used in the puck assembly shown in FIG. 3.

Referring to FIGS. 4 and 5, puck 106 has a top surface 149 defined on first side 138 of body portion 136. In the example embodiment, recess 142 has a depth D defined by a distance between partition wall 146, or insert label 110, and top surface 149. In addition, the plurality of compartments 116 each have a height H. In the example embodiment, depth D is greater than height H such that the plurality of compartments 116 are positioned a distance below first wall 112 (shown in FIG. 2) when puck assembly 104 is positioned within carton 102.

Figure 6:
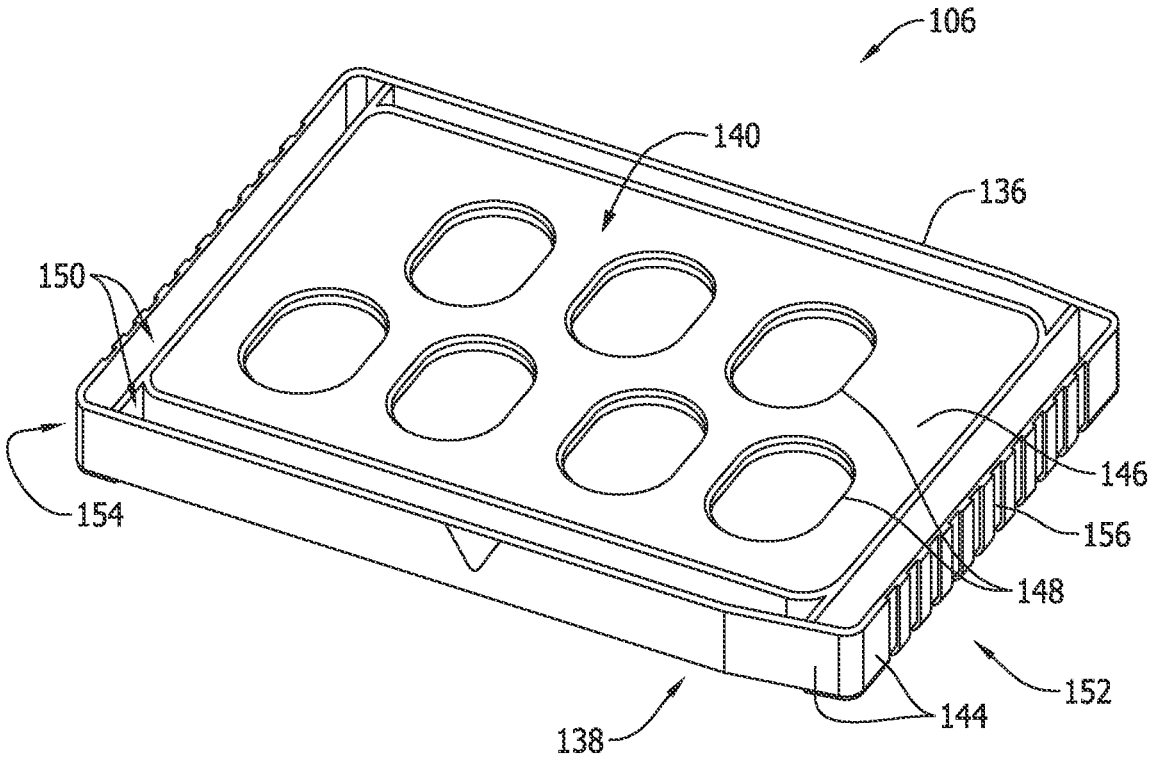
FIG. 6 is a perspective view of a second side of the puck shown in FIG. 5.

Referring to FIGS. 5 and 6, second side 140 of body portion 136 includes a plurality of reinforced cavities 150 extending between side walls 144 of puck 106 and partition wall 146. Alternatively, the space defined between side walls 144 and partition wall 146 may be substantially solid. Forming puck 106 with reinforced cavities 150 facilitates reducing the weight, material use, and manufacturing cost of puck 106. Moreover, puck 106 may be fabricated from any material that enables container assembly 100 to function as described herein. Example puck materials include, but are not limited to, paper-based material and plastic material.

In the example embodiment, body portion 136 of puck 106 includes a first end 152 and a second end 154. Side walls 144 at first end 152 are angled inwardly relative to a longitudinal centerline of body portion 136 to define a taper at first end 152 of body portion 136. As such, first end 152 has a reduced width, which enables puck 106 to be inserted into an open end of carton 102 more easily. In addition, in the example embodiment, side walls 144 at first end 152 and second end 154 are both formed with a ribbed surface 156. Ribbed surface 156 provides a greater surface area for the application of adhesive to puck 106 when securing puck 106 to carton 102.

Figure 3:
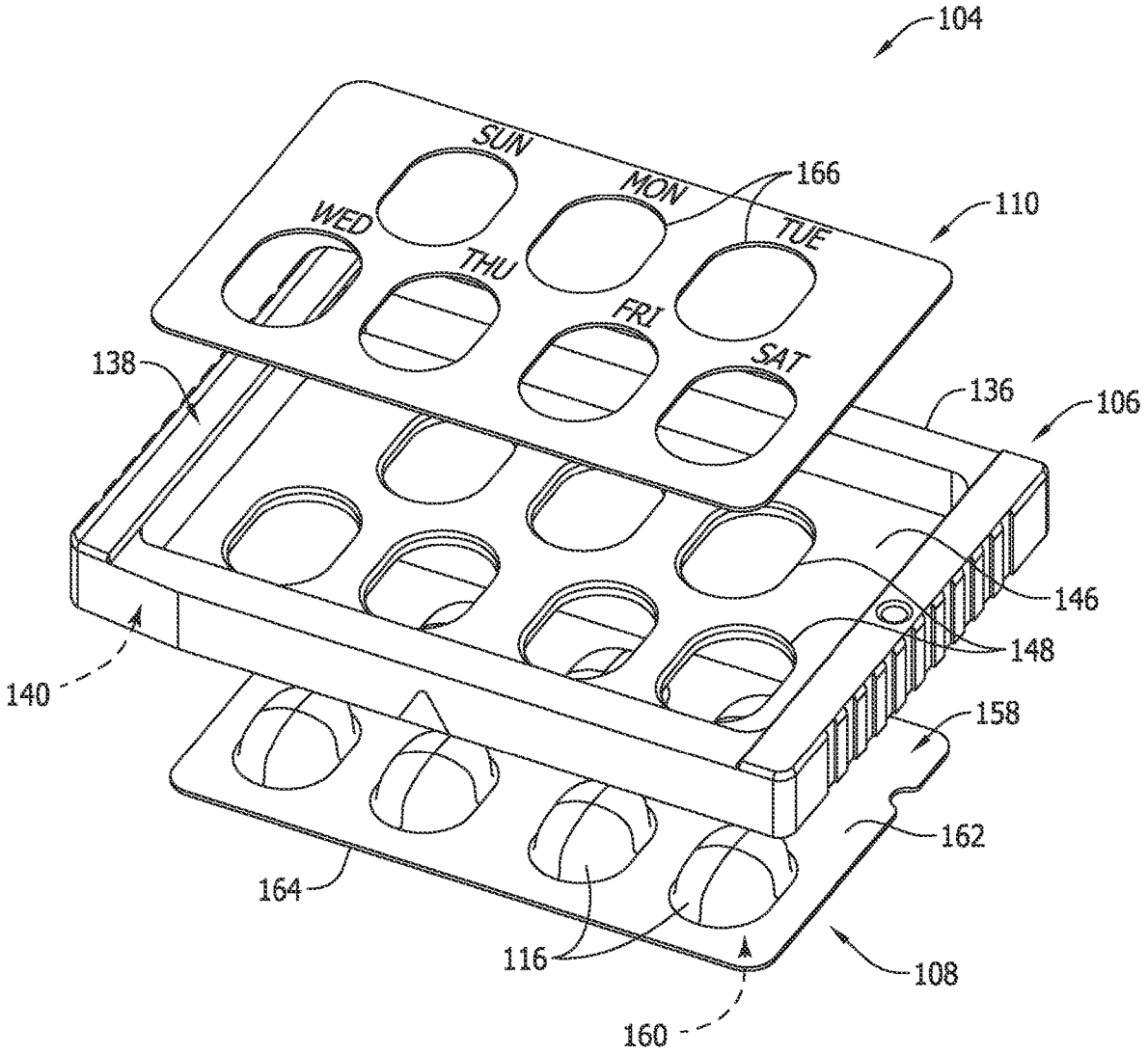
FIG. 3 is an exploded view of an example puck assembly that may be used in the container assembly shown in FIG. 1.
Figure 7:
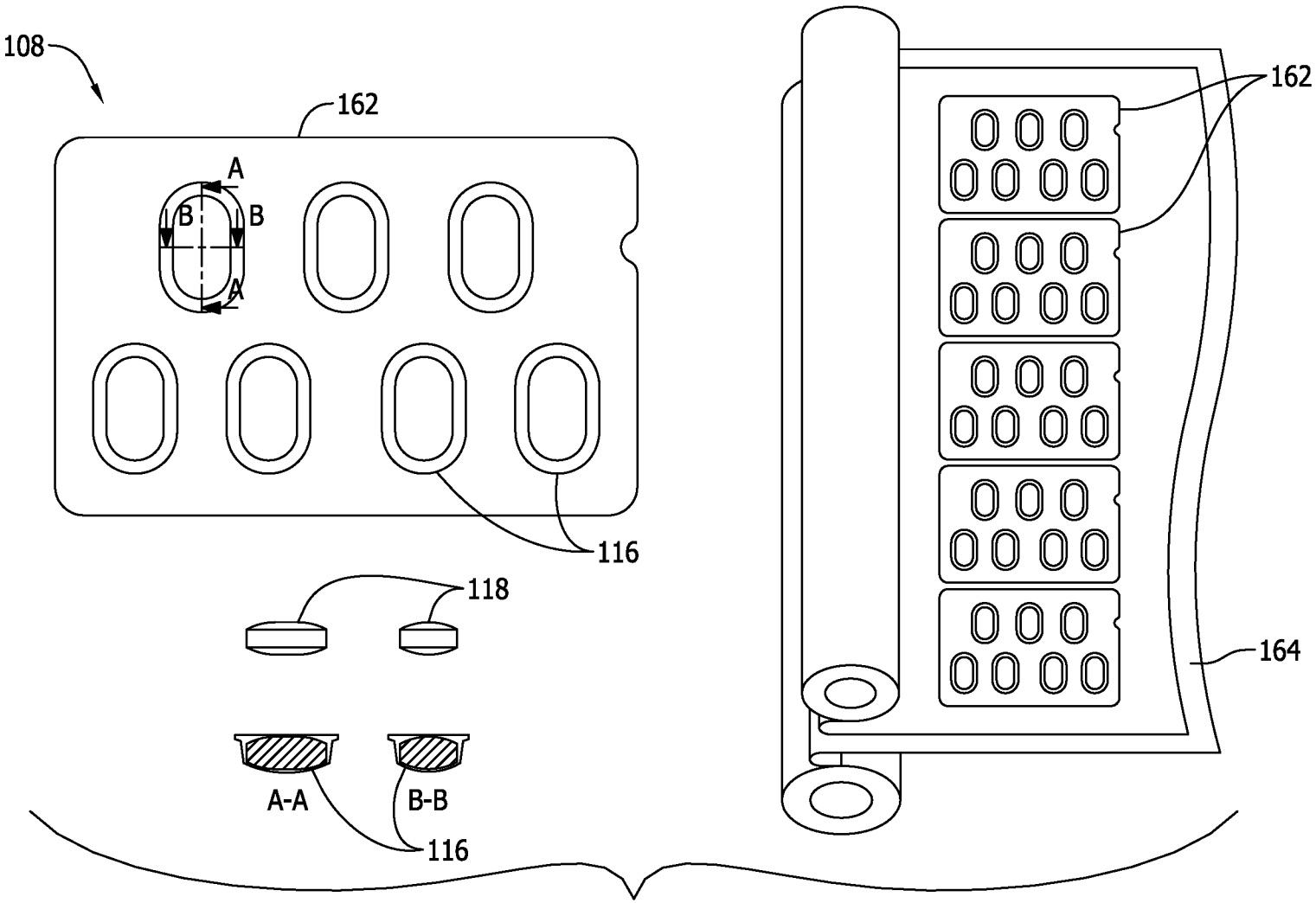
FIG. 7 is an illustration of engineering drawing specifications of an example blister card that may be used in the puck assembly shown in FIG. 3.

Referring to FIGS. 3 and 7, blister card 108 includes a first side 158 and a second side 160. Blister card 108 is formed from a semi-rigid plastic film or member 162 on first side 158 of blister card 108, and a sealing layer 164 formed from foil or paper adhered to member 162 on second side 160 of blister card 108. Blister card 108 further includes a plurality of compartments 116 formed in member 162 and protruding from first side 158 of blister card 108. Each compartment 116 is sized and shaped to receive dosage 118 (shown in FIG. 2) of medication therein in pill-form. The plurality of compartments 116 also define an opening on second side 160 of blister card 108, which provides access to compartments 116 prior to adhering sealing layer 164 to blister card 108. More specifically, sealing layer 164 overlays the openings on second side 160 of blister card 108 such that a seal for securing each dosage 118 of medication in respective compartments 116 is formed. As such, each dosage 118 of medication is sealed within respective compartments 116, thereby protecting the medication from a surrounding environment. As will be explained in further detail below, dosages 118 of medication are accessible by applying a force on first side 158 of blister card 108 to a corresponding compartment 116, which causes sealing layer 164 to be punctured and allows dosage 118 to be discharged through the opening in the corresponding compartment 116. In some examples, blister card 108 may include a notch or other surface feature for ease in forming the carton 102.

In the example embodiment, container assembly 100 is fitted with a blister card 108 that includes seven compartments 116 when container assembly 100 is configured for storing and dispensing medication that needs to be administered once a day. As such, container assembly 100 is capable of storing and dispensing a week's worth of medication using a thin and portable container such that a user need not carry a whole prescription's worth of medication with them when not at a primary storage location for the prescription.

The plurality of compartments 116 of the blister card 108 may have a variety of sizes and shapes in order to accommodate different types, sizes, and doses of medication. For example, compartments 116 may be circular, ovular, cuboidal, rectangular, and the like. Similarly, blister card 108 may include compartments 116 including any suitable combination of shapes and sizes. In other words, because a dosage 118 of medication in the form of a pill or capsule may have many sizes and shapes, blister card 108 can be manufactured to accommodate the specific size and shape of one or more types of medication. Further, many medications are adapted to be taken multiple times a day, at specific times of the day, and/or in combination with other medications. Therefore, compartments 116 may be sized, shaped, and arranged to store medications in any suitable orientation to specify an order or series of administration, for example, such as in the alternative container assembly embodiment that will be described in more detail below. The plurality of compartments 116 may be sized and shaped to allow easy access to and removal of the dosage 118 of medication from the plurality of compartments.

Referring again to FIGS. 3 and 4, label insert 110 is positioned within recess 142 of puck 106. In one embodiment, label insert 110 is adhered to partition wall 146 on first side 138 of puck 106. Label insert 110 includes a plurality of openings 166 defined therein, and each opening 166 in label insert 110 corresponds to one of the plurality of compartments 116 in blister card 108 and to one of the plurality of openings 148 in partition wall 146. As such, label insert 110 does not impede insertion of compartments 116 through openings 148 in partition wall 146 when aligning puck 106 and blister card 108 relative to each other.

In the example embodiment, label insert 110 includes information printed thereon. More specifically, label insert 110 has the days of the week printed thereon, and the text associated with each day of the week is printed adjacent a respective opening 166. As such, a user is provided with the ability to easily determine which dosage 118 to dispense from container assembly 100, and to easily track medication usage over the course of a week, which may improve compliance and adherence to a prescription and/or treatment plan.

Figure 8:
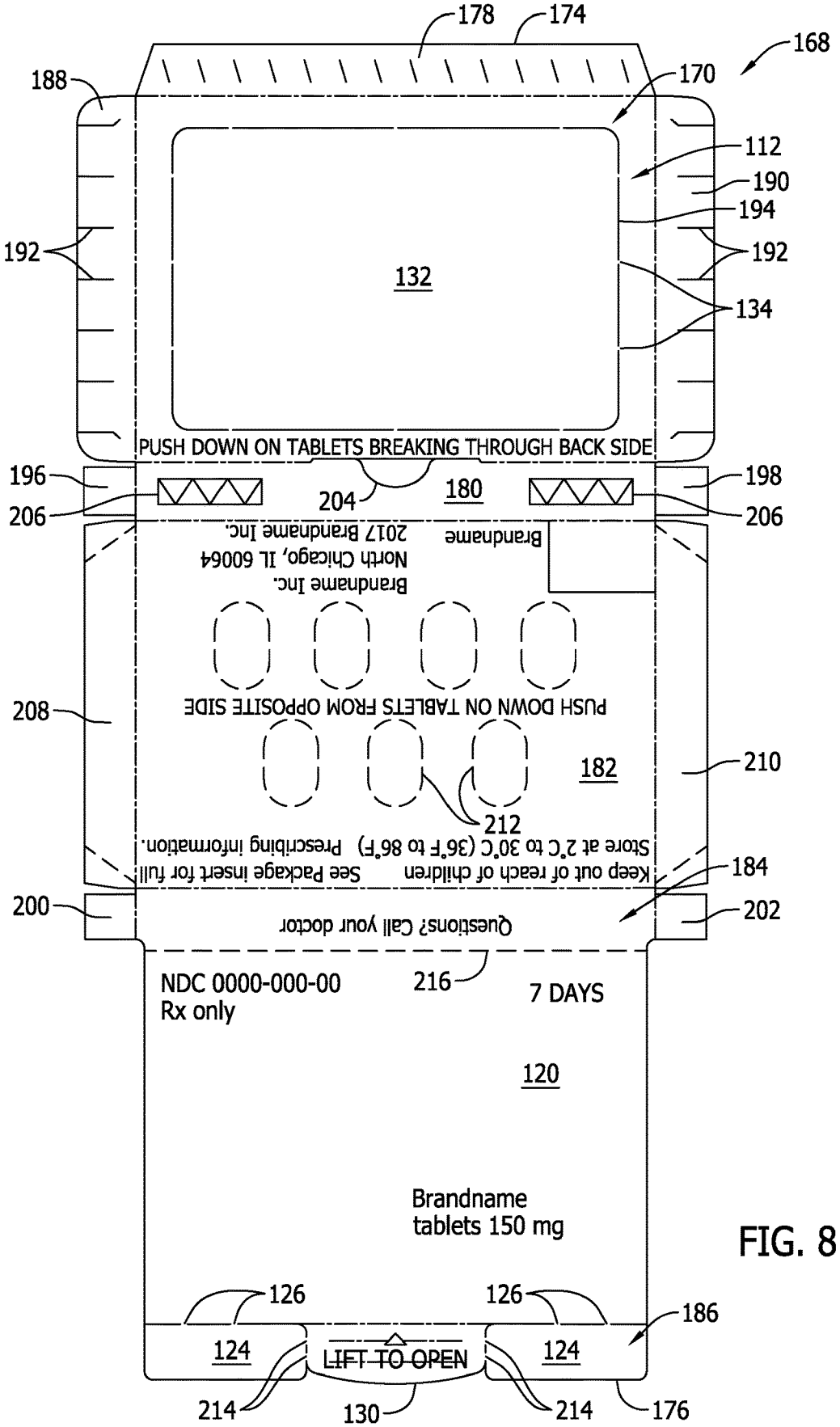
FIG. 8 is a top plan view of a blank of sheet material for forming an example carton that may be used in the container assembly shown in FIG. 1.
Figure 9:
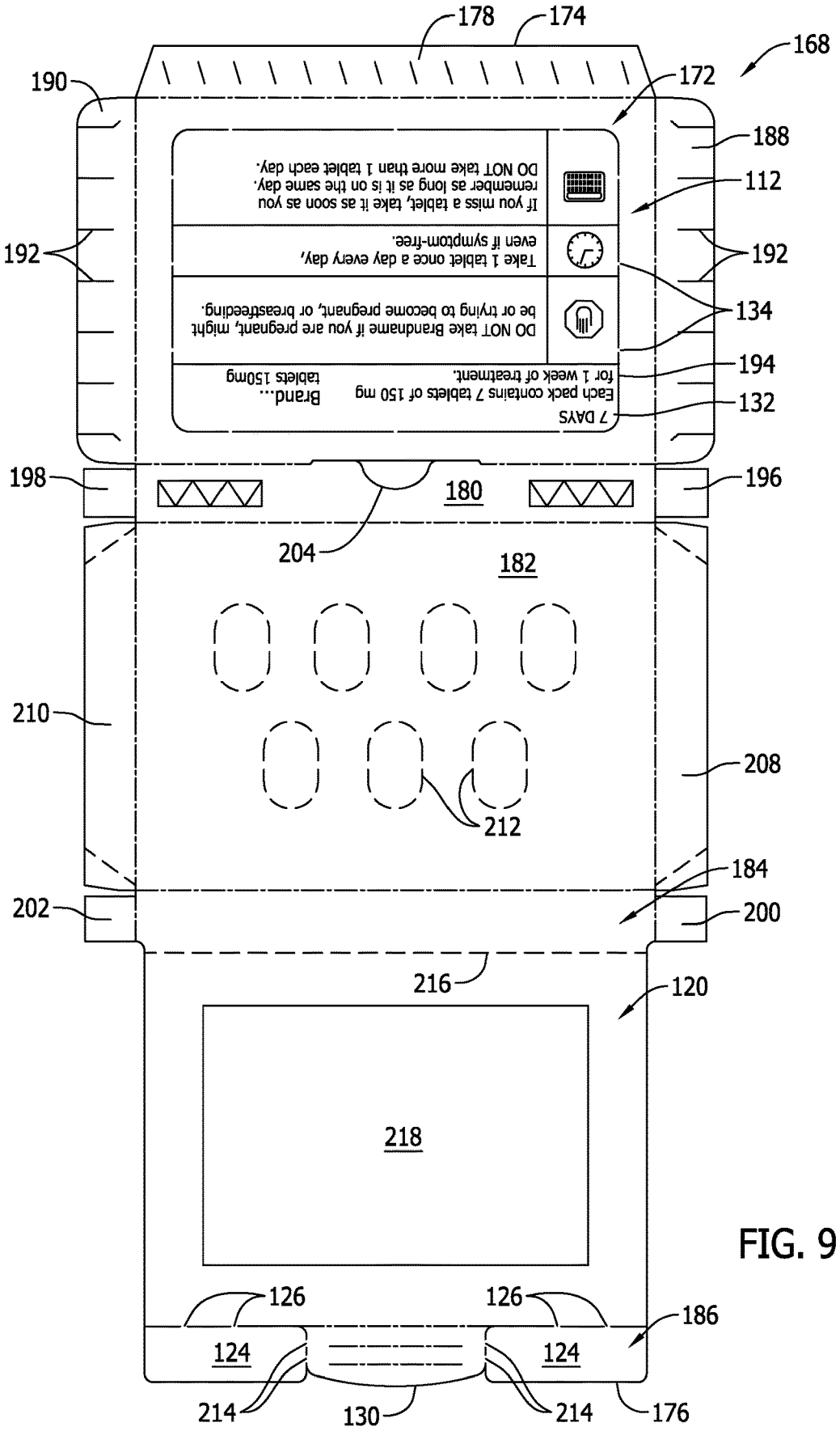
FIG. 9 is a bottom plan view of the blank of sheet material shown in FIG. 8.

Referring to FIGS. 8 and 9, FIG. 8 is a top plan (exterior) view of a blank 168 of sheet material for forming carton 102 (shown in FIGS. 1 and 2), and FIG. 9 is a bottom plan (interior) view of blank 168. In the example embodiment, blank 168 has a first surface 170 and an opposing second surface 172. Further, blank 168 defines a leading edge 174 and a trailing edge 176. Blank 168 includes, from leading edge 174 to trailing edge 176, a first joining flap 178, a first wall 112, a first side wall 180, a second wall 182, a second side wall 184, a third wall 120, and a second joining flap 186. First side wall 180 and second side wall 184 have a lesser width than first wall 112 and second wall 182 to facilitate defining the substantially thin profile of carton 102.

First wall 112 includes a first end flap 188 and a second end flap 190 extending from opposing sides of first wall 112. First end flap 188 and second end flap 190 each include a plurality of score lines 192 defined therein. First wall 112 also includes perforated cutout 194 for defining removable panel 132. More specifically, a plurality of connector tabs 134 define perforated cutout 194, and connector tabs 134 facilitate separation of removable panel 132 from first wall 112.

First side wall 180 includes a first auxiliary tab 196 and a second auxiliary tab 198 extending from opposing sides of first side wall 180. Likewise, second side wall 184 includes a first auxiliary tab 200 and a second auxiliary tab 202 extending from opposing sides of second side wall 184. First side wall 180 further includes a contoured cut line 204 defined therein that at least partially extends between first wall 112 and first side wall 180. Contoured cut line 204 is formed in blank 168 to facilitate defining tab slot 128 (shown in FIG. 2). First side wall 180 also includes a pair of adhesive zones 206. As will be explained in more detail below, the pair of adhesive zones 206 are for receiving adhesive thereon, and are configured to align with breakaway tabs 124 when forming carton 102.

Second wall 182 includes a first end flap 208 and a second end flap 210 extending from opposing sides of second wall 182. When forming carton 102, first end flap 188, second end flap 190, first auxiliary tab 196, second auxiliary tab 198, first auxiliary tab 200, second auxiliary tab 202, first end flap 208, and second end flap 210 are joined together in a glued-end construction to define end walls of carton 102. Second wall 182 also includes a plurality of perforations 212 defined therein. When carton 102 is formed, first wall 112 is opposite second wall 182, and each perforation 212 corresponds to one of the plurality of compartments 116 in blister card 108 (both shown in FIGS. 2-4). As such, applying a force to each compartment 116 causes sealing layer 164 to be punctured and also causes an opening to be formed in second wall 182 at a corresponding perforation 212 such that a dosage 118 of medication can be dispensed from container assembly 100.

Second joining flap 186 includes securing tab 130 and the pair of breakaway tabs 124 positioned on opposing sides of securing tab 130. As noted above, breakaway tabs 124 are coupled to third wall 120 with at least one connector tab 126.

In addition, breakaway tabs 124 are coupled to securing tab 130 with at least one connector tab 214. Thus, to position third wall 120 in an open position from an initially secured state, having breakaway tabs 124 adhered to adhesive zones 206, a user breaks connector tab 214 to separate securing tab 130 from breakaway tabs 124, breaks connector tabs 126 to separate third wall 120 from breakaway tabs 124, and rotates third wall 120 about a line of weakness 216 defined between second side wall 184 and third wall 120. Line of weakness 216 enables third wall 120 to optionally be separated from container assembly 100, which facilitates providing unimpeded access to blister card 108 through access opening 114 as shown in FIG. 2.

Referring to FIG. 9, as noted above, removable panel 132 includes information related to administration of the medication printed thereon. In addition, third wall 120 includes an adhesive zone 218 defined thereon, and for receiving adhesive thereon. Adhesive zone 218 is configured to align with removable panel 132 when forming carton 102 such that removable panel 132 becomes adhered to third wall 120. As such, when third wall 120 is rotated into an open position from the initially secured state, connector tabs 134 are broken, removable panel 132 is separated from first wall 112, thereby defining access opening 114, and removable panel 132 is conveniently located on third wall 120 for providing information related to administration of the medication to the user.

Figure 10:
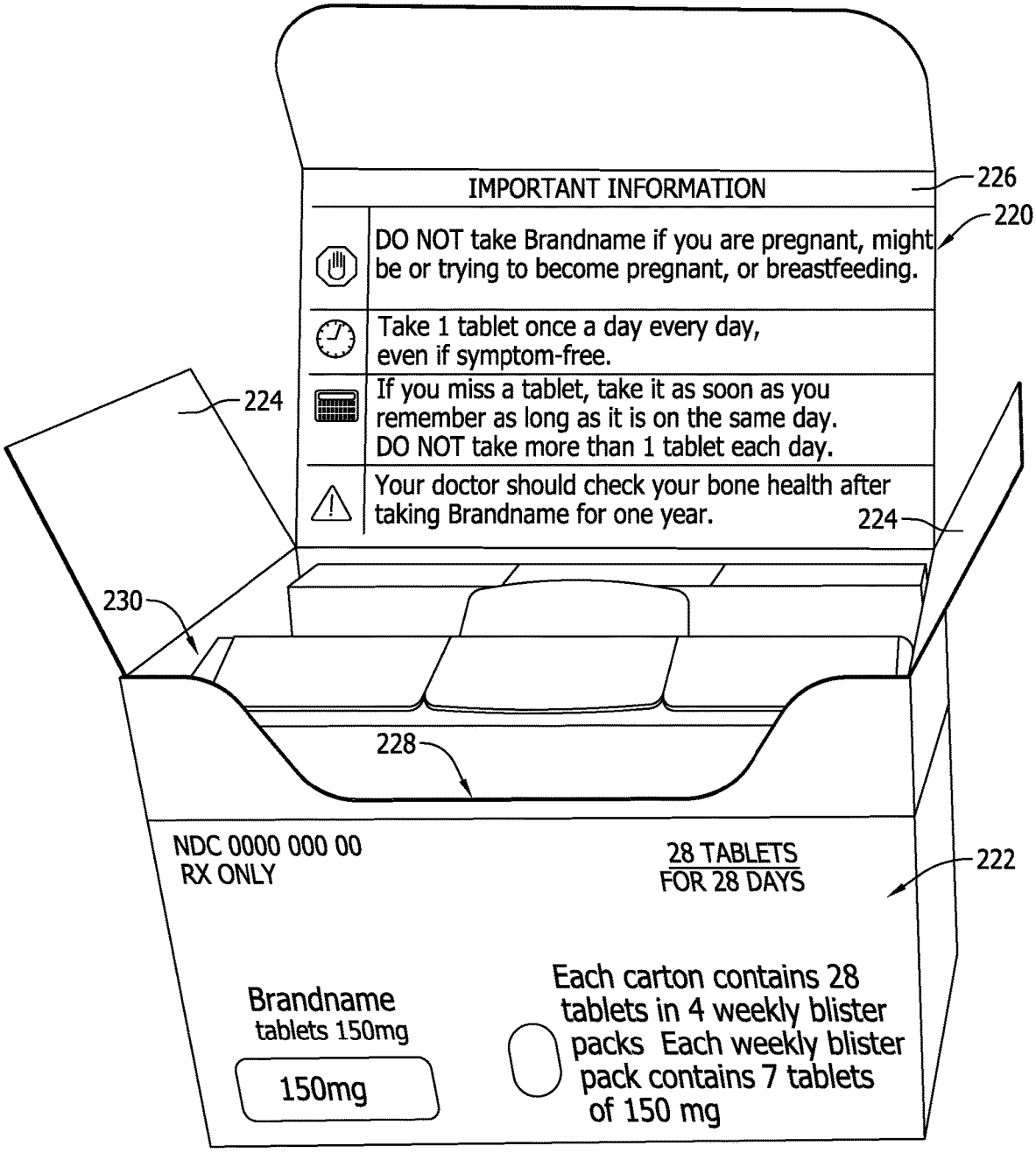
FIG. 10 is a perspective view of an example overpack carton for storing and transporting multiple child-resistant medication container assemblies.
Figure 11:
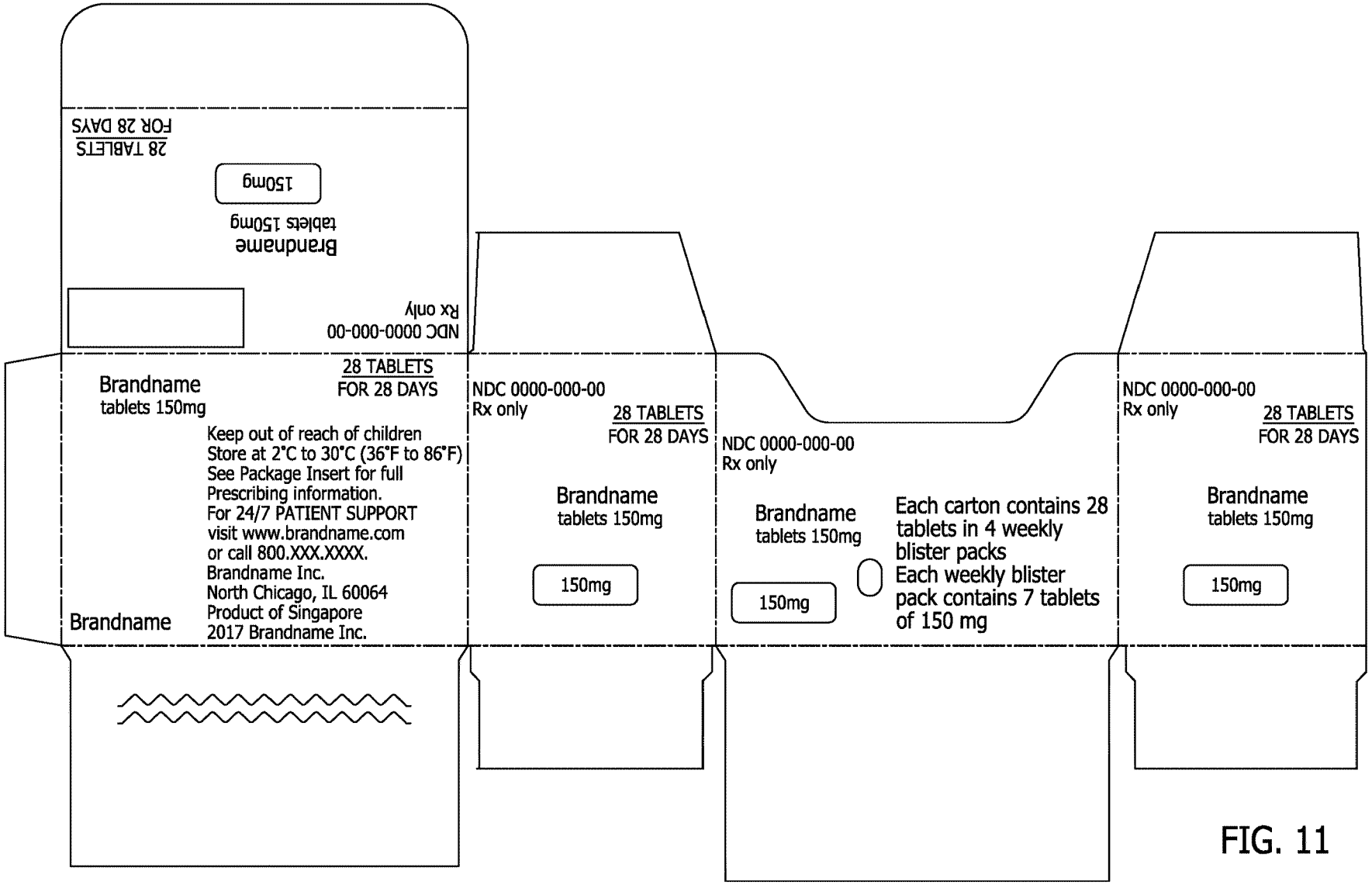
FIG. 11 is a top plan view of an example blank of sheet material for forming the overpack carton shown in FIG. 10.
Figure 12:
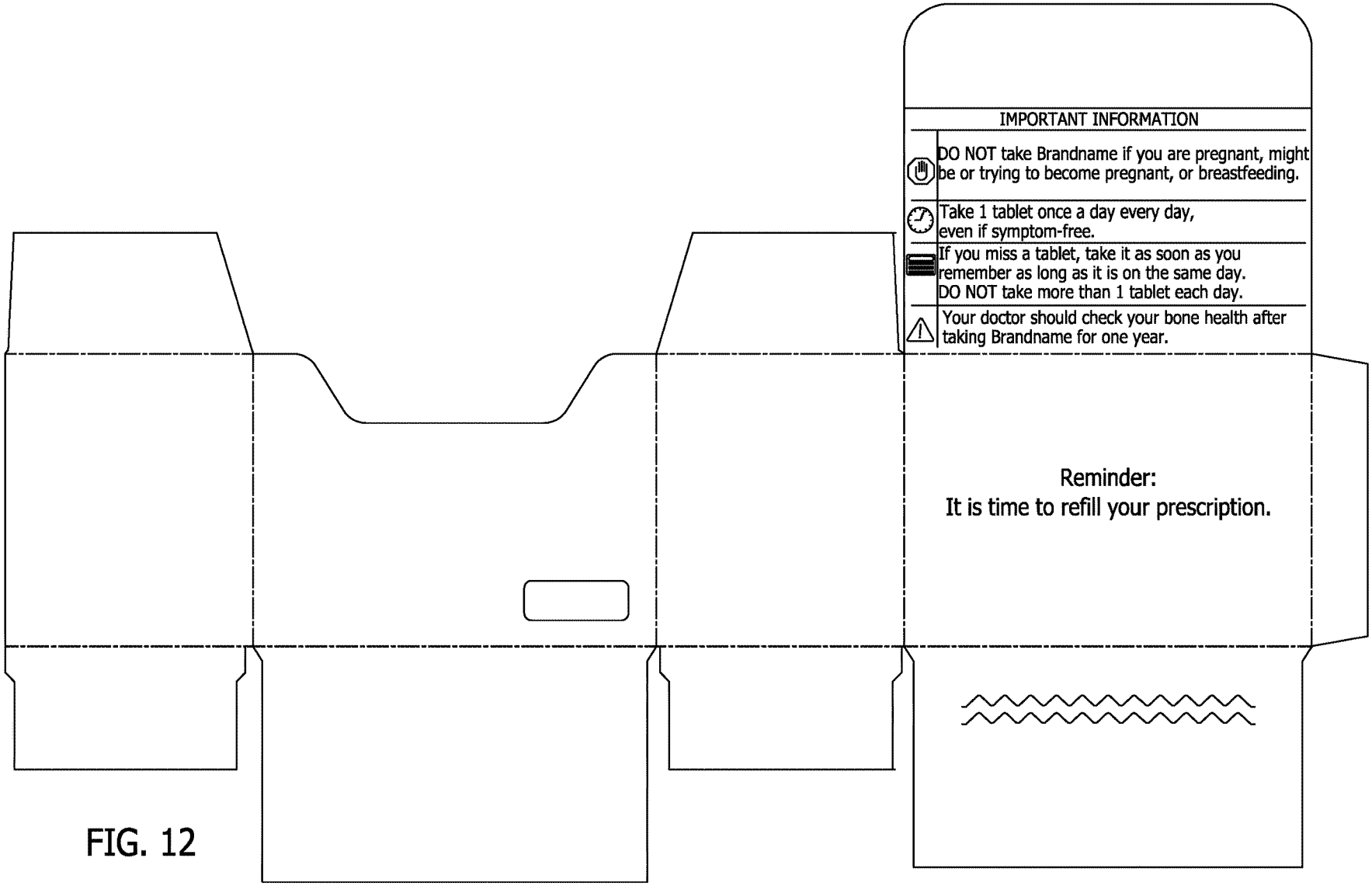
FIG. 12 is a bottom plan view of the blank of sheet material shown in FIG. 11.
Figure 13:
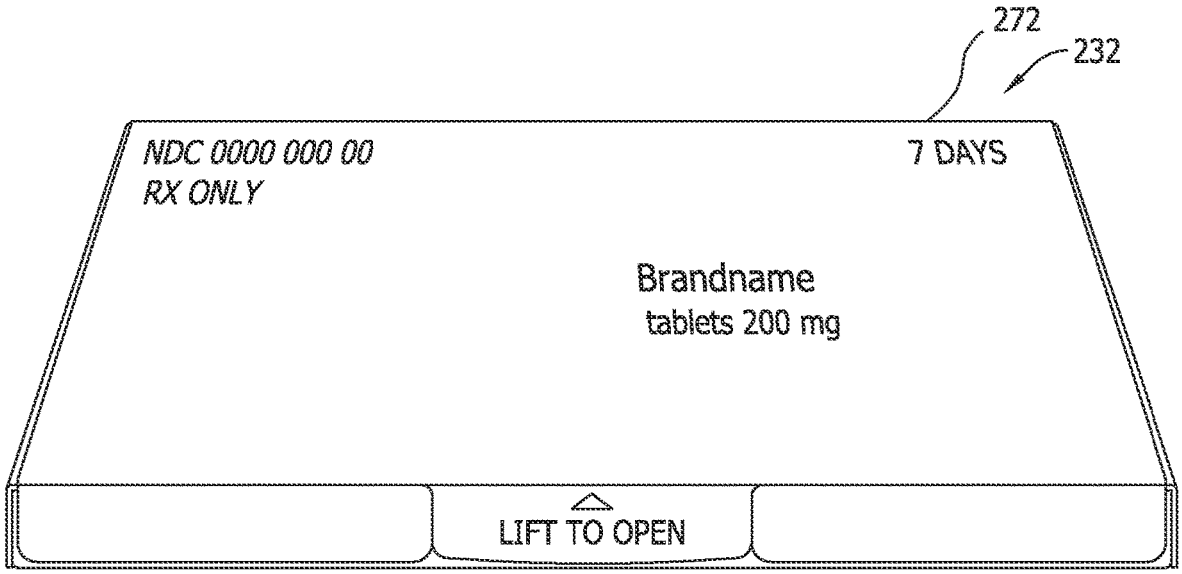
FIG. 13 is a perspective view of an additional child-resistant medication container assembly, the container assembly having a cover in a closed position.
Figure 14:
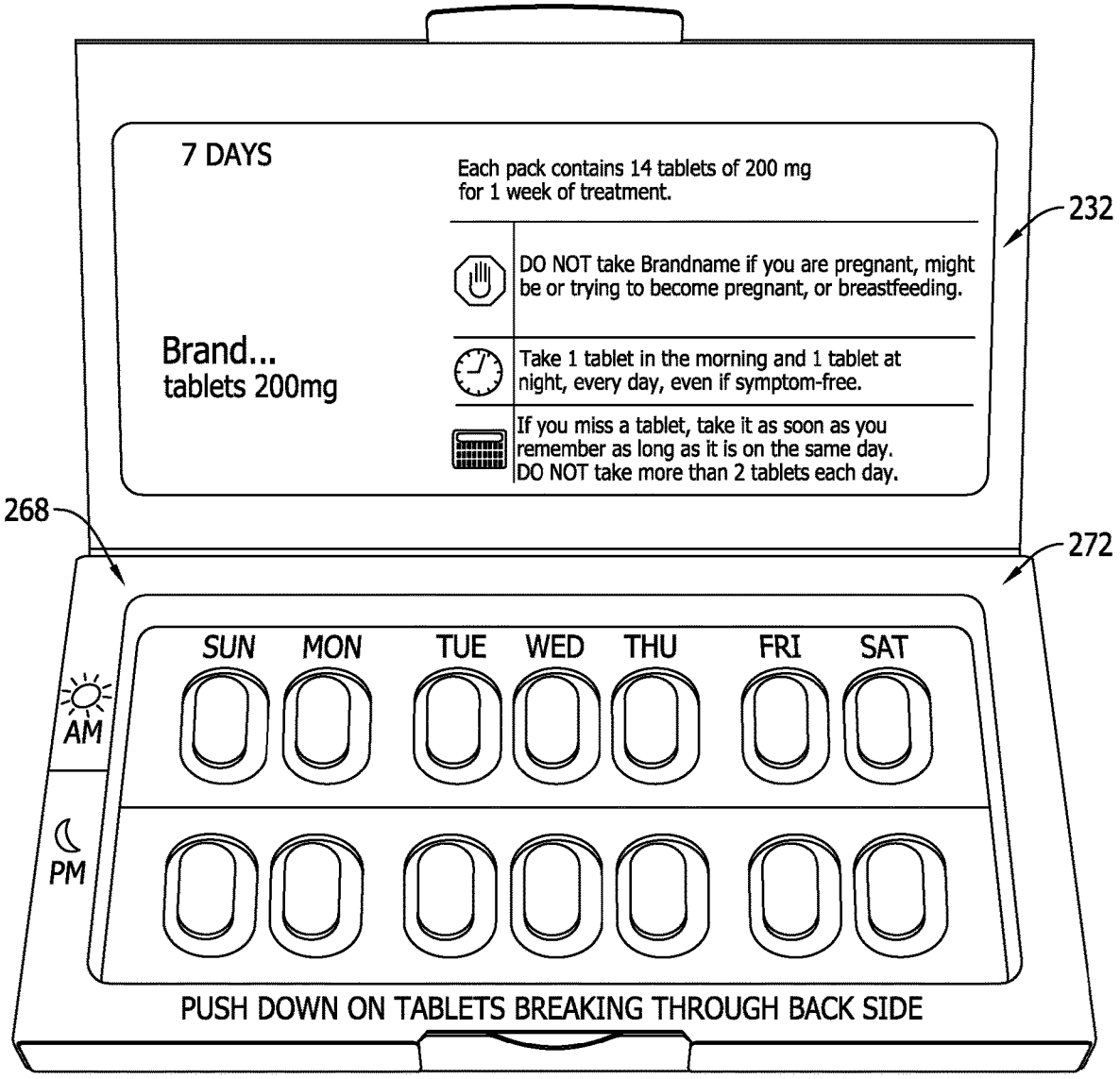
FIG. 14 is a perspective view of the child-resistant medication container assembly shown in FIG. 13 with the cover in an open position.
Figure 15:
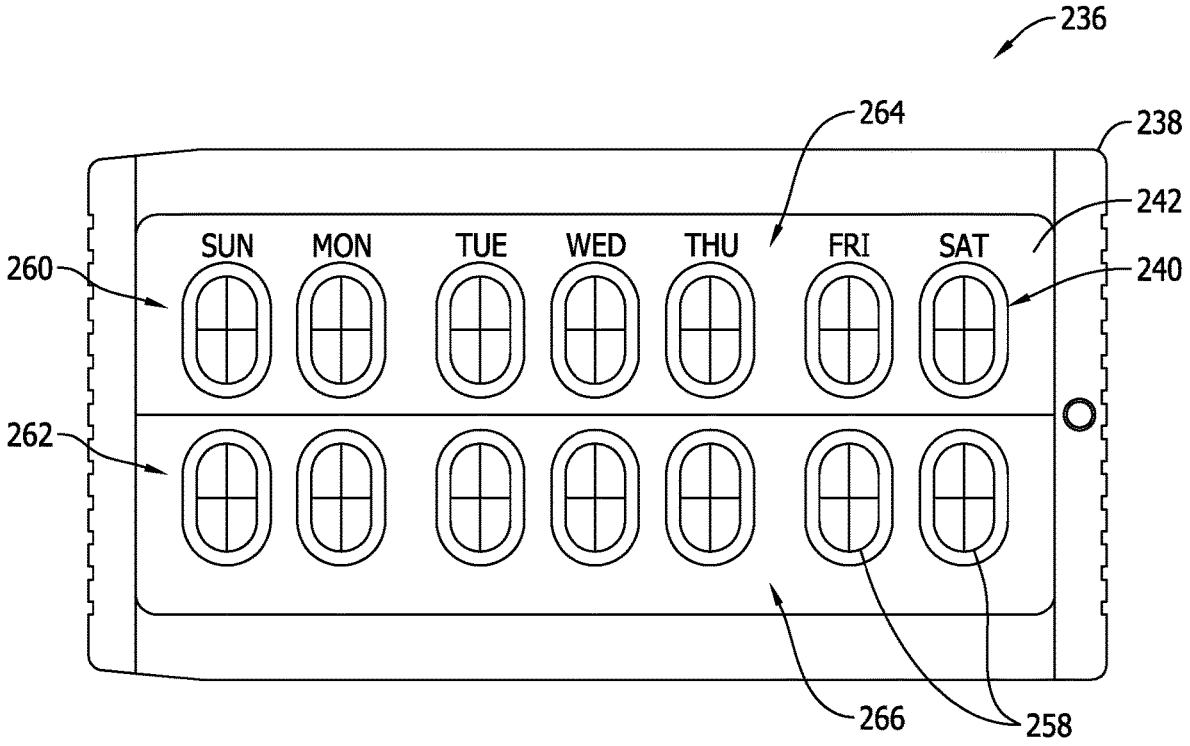
FIG. 15 is a top view of an alternative puck and an alternative label insert that both may be used with the container assembly shown in FIG. 13.
Figure 16:
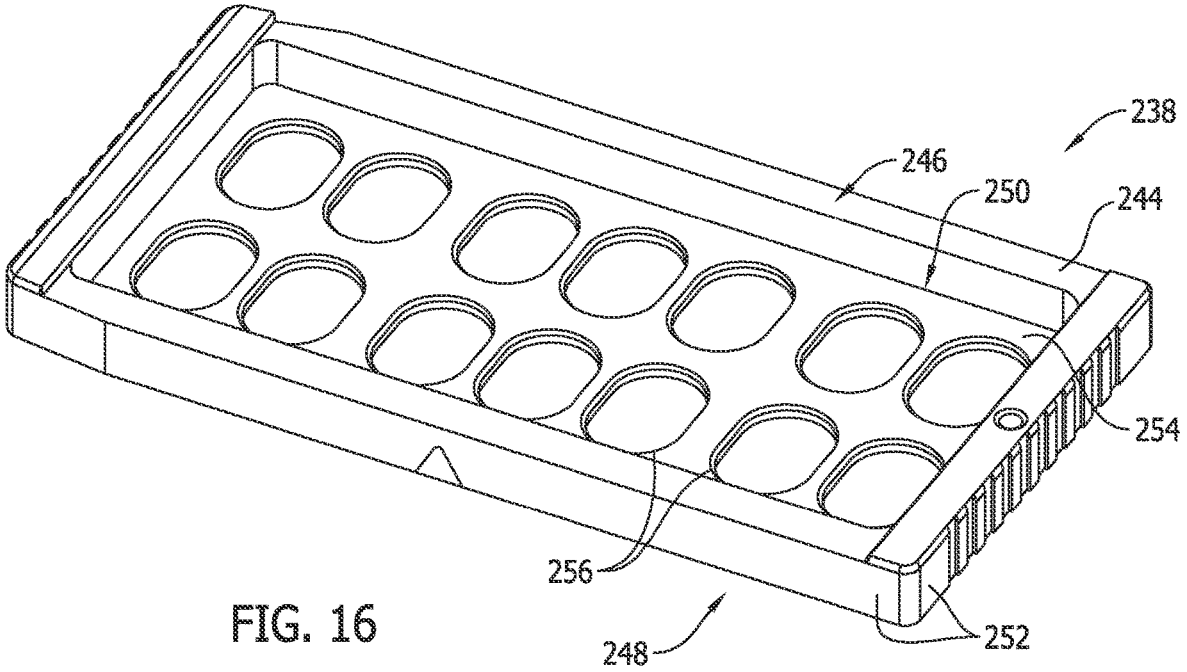
FIG. 16 is a perspective view of a first side of the puck shown in FIG. 15.
Figure 17:
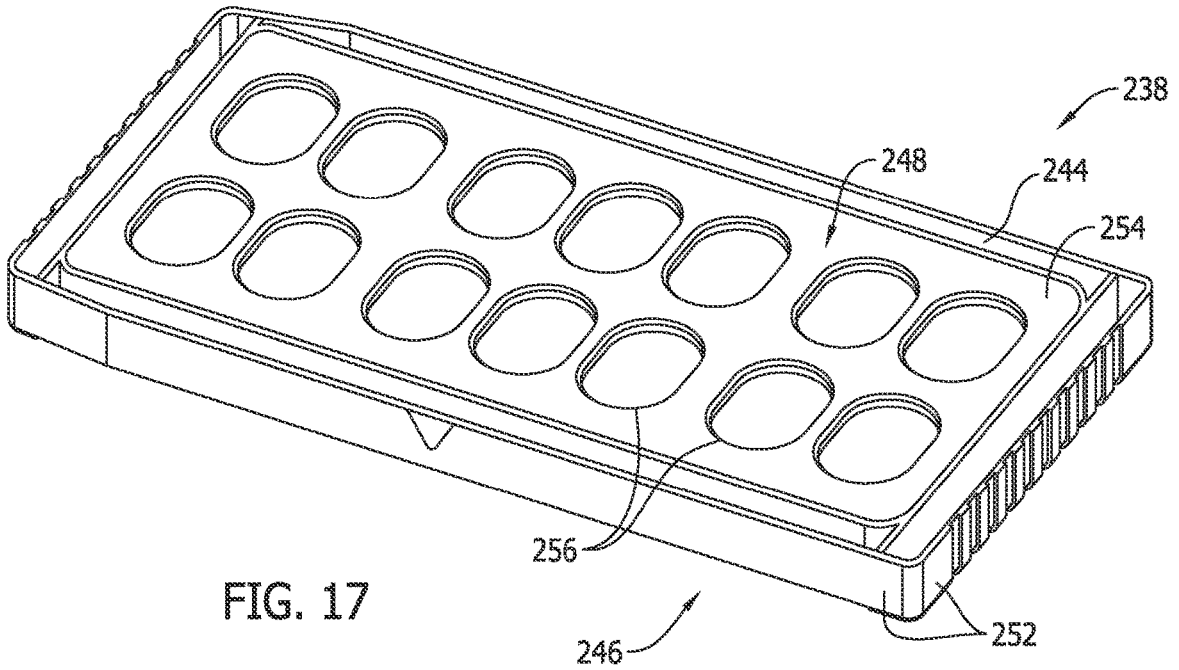
FIG. 17 is a perspective view of a second side of the puck shown in FIG. 15.
Figure 18:
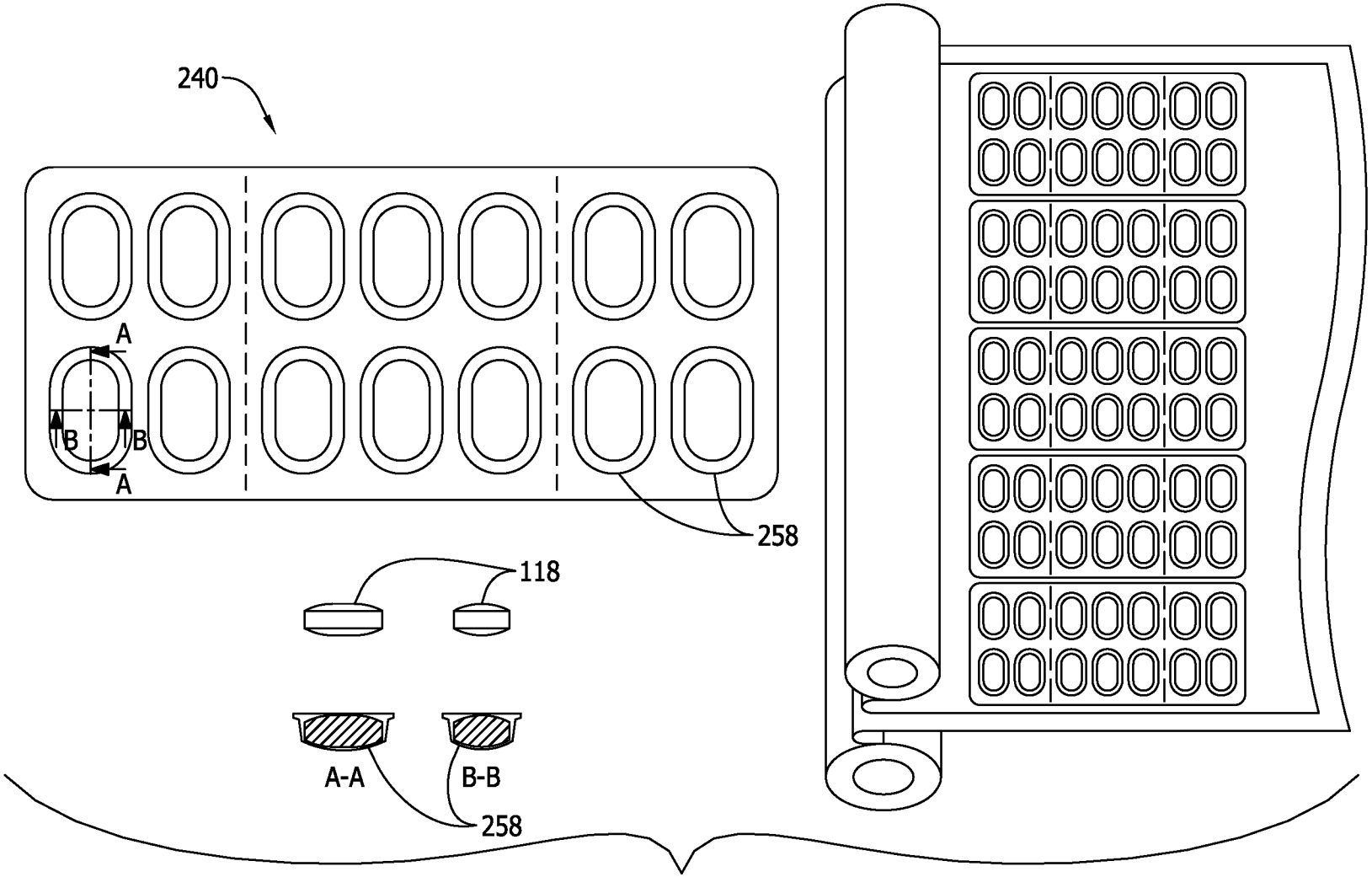
FIG. 18 is an illustration of engineering drawing specifications of an alternative blister card that may be used with the puck shown in FIG. 15.

FIGS. 10-12 illustrate an overpack carton 220 for storing and transporting multiple child-resistant medication container assemblies 100. In the example embodiment, overpack carton 220 includes a container portion 222, a pair of side flaps 224, and a cover 226. Container portion 222 defines an interior 228 sized to receive multiple container assemblies 100 therein. Container assemblies 100 are insertable into interior 228 through an open top 230 of container portion 222. Side flaps 224 and cover 226 may then be used to enclose container assemblies 100 within interior 228 in anticipation of storing or transporting overpack carton 220, for example. The user may then open overpack carton 220 to retrieve container assemblies 100 therefrom.

FIGS. 13-23 illustrate an additional child-resistant medication container assembly 232, and an alternative overpack carton 234 for storing and transporting multiple child-resistant medication container assemblies 232. In general, container assembly 232 contains all the features of container assembly 100, but is sized to accommodate a greater number of dosages 118 of medication than container assembly 100. For example, medication container assembly 232 has a similar thin profile as container assembly 100, but has a greater length and width than container assembly 100.

Likewise, referring to FIGS. 15-18, container assembly 232 includes a puck assembly 236 that is sized to accommodate a greater number of dosages 118 of medication than puck assembly 104. Similar to puck assembly 104, puck assembly 236 includes a puck 238, a blister card 240, and a label insert 242. In the example embodiment, puck 238 includes a body portion 244 having a first side 246 and a second side 248. A recess 250 is defined in first side 246, and recess 250 defines side walls 252 of puck 238. Recess 250 also defines a partition wall 254 in body portion 244, and a plurality of openings 256 are defined in partition wall 254. Each opening 256 corresponds to one of a plurality of compartments 258 in blister card 240 such that openings 256 in puck 238 are configured to align with compartments 258 of blister card 240 having a specific and predetermined orientation. For example, the number of compartments 258 in blister card 240 is a multiple of the number of days in the week. As such, puck 238 includes the same number of openings 256 as the number of compartments 258 in blister card 240 such that each compartment 258 is inserted through a respective corresponding opening 256 when puck 238 and blister card 240 are aligned with each other. In some embodiments, blister card 240 is adhered to second side 248 of puck 238.

In the example embodiment, container assembly 232 is fitted with blister card 240 that includes fourteen compartments 258 when container assembly 232 is configured for storing and dispensing medication that needs to be administered twice a day. For example, referring again to FIGS. 15-18, the plurality of openings 256 and the plurality of compartments 258 are arranged in a pair of rows, including a first row 260 and a second row 262 each having seven openings 256 and seven compartments 258. In one embodiment, when the user needs to administer the medication twice a day, such as in the morning and in the afternoon, compartments 258 in first row 260 are aligned with corresponding compartments 258 in second row 262 such that the compartments are arranged in pairs. In addition, label insert 242 has the days of the week printed thereon, and the text associated with each day of the week is printed to align with each pair of compartments.

In one embodiment, label insert 242 is color-coded, or otherwise provided with distinguishing markings, to facilitate distinguishing between the medication contained in first row 260 and in second row 262. In some examples, the label insert may include multiple zones to indicate, different dosage times. In the example embodiment, label insert 242 includes a first zone 264 having a first color and a second zone 266 having a second color. First zone 264 is configured to align with first row 260 and second zone 266 is configured to align with second row 262 when label insert 242 is coupled to puck 238. Moreover, in one embodiment, a first wall 268 (shown in FIG. 14) of container assembly 232 is also color-coded, and/or includes informational text, and/or other visual indicators (e.g. sun and moon representations), in a manner such that first zone 264 and second zone 266 align with color-coded portions of first wall 268 when puck assembly 236 is positioned within the carton. As such, a user is provided with the ability to easily determine which dosage 118 to dispense from container assembly 232, and to easily track medication usage during the day and over the course of a week.

Figure 19:
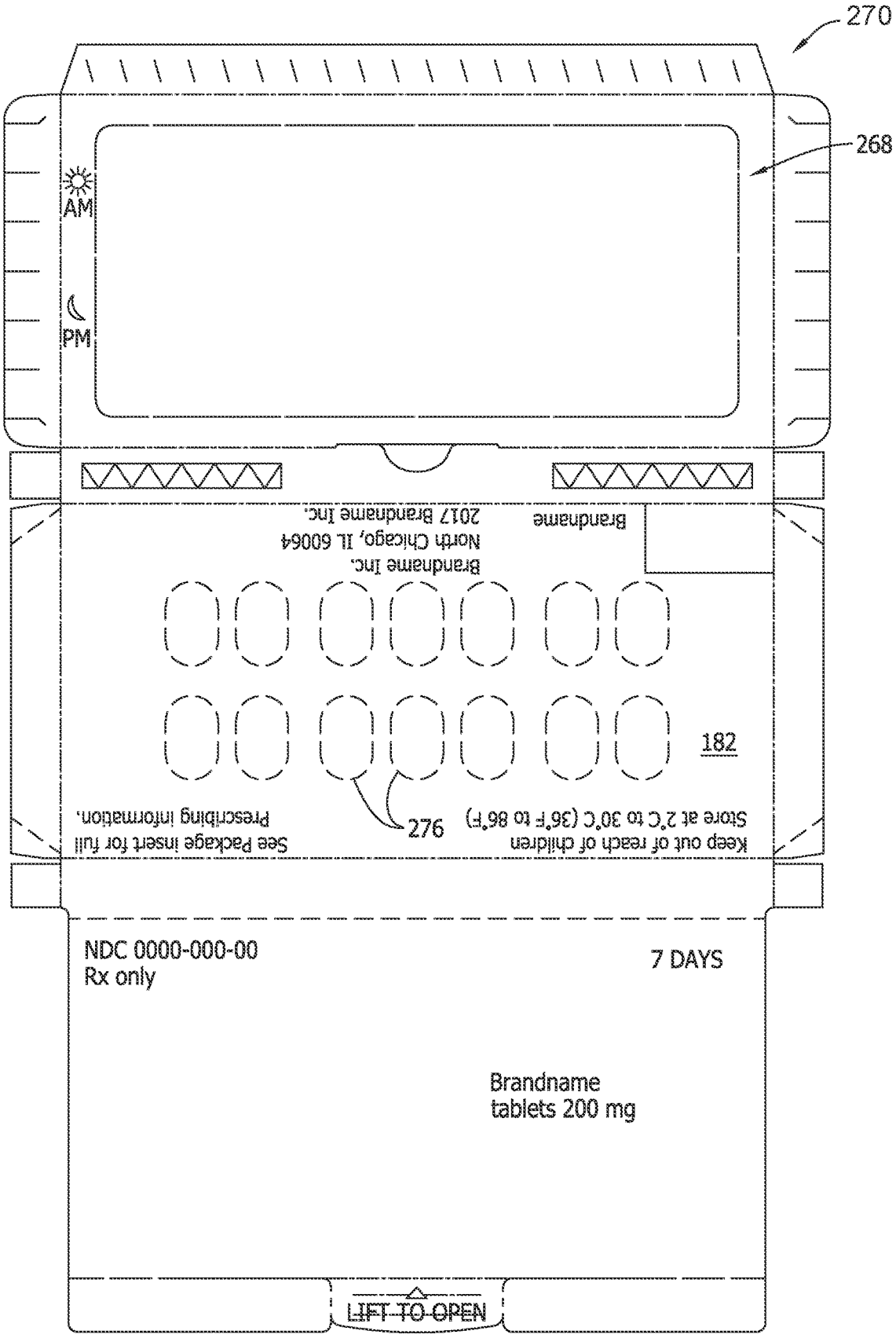
FIG. 19 is a top plan view of a blank of sheet material for forming an alternative carton that may be used in the container assembly shown in FIG. 13.
Figure 20:
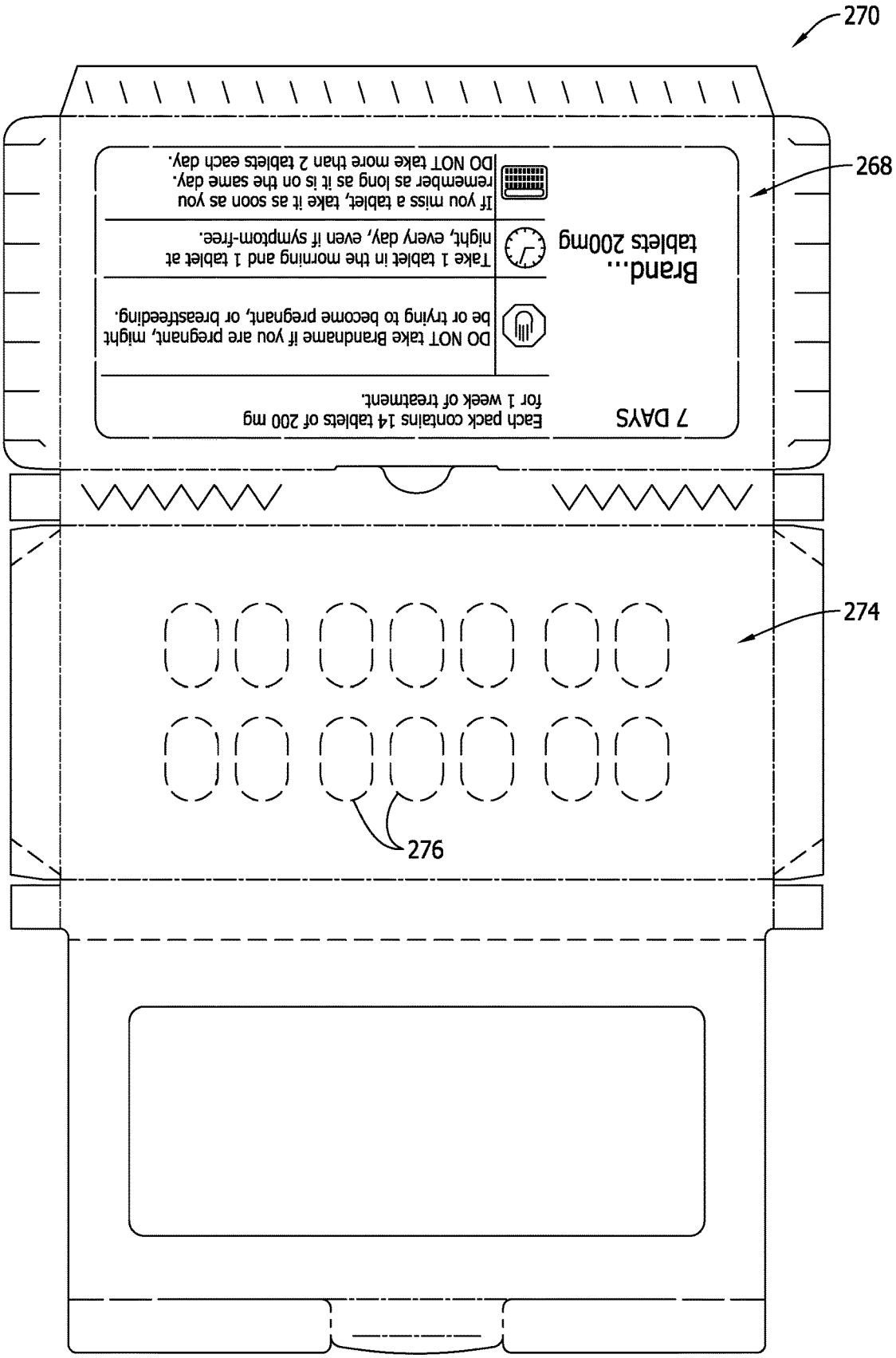
FIG. 20 is a bottom plan view of the blank of sheet material shown in FIG. 19.
Figure 21:
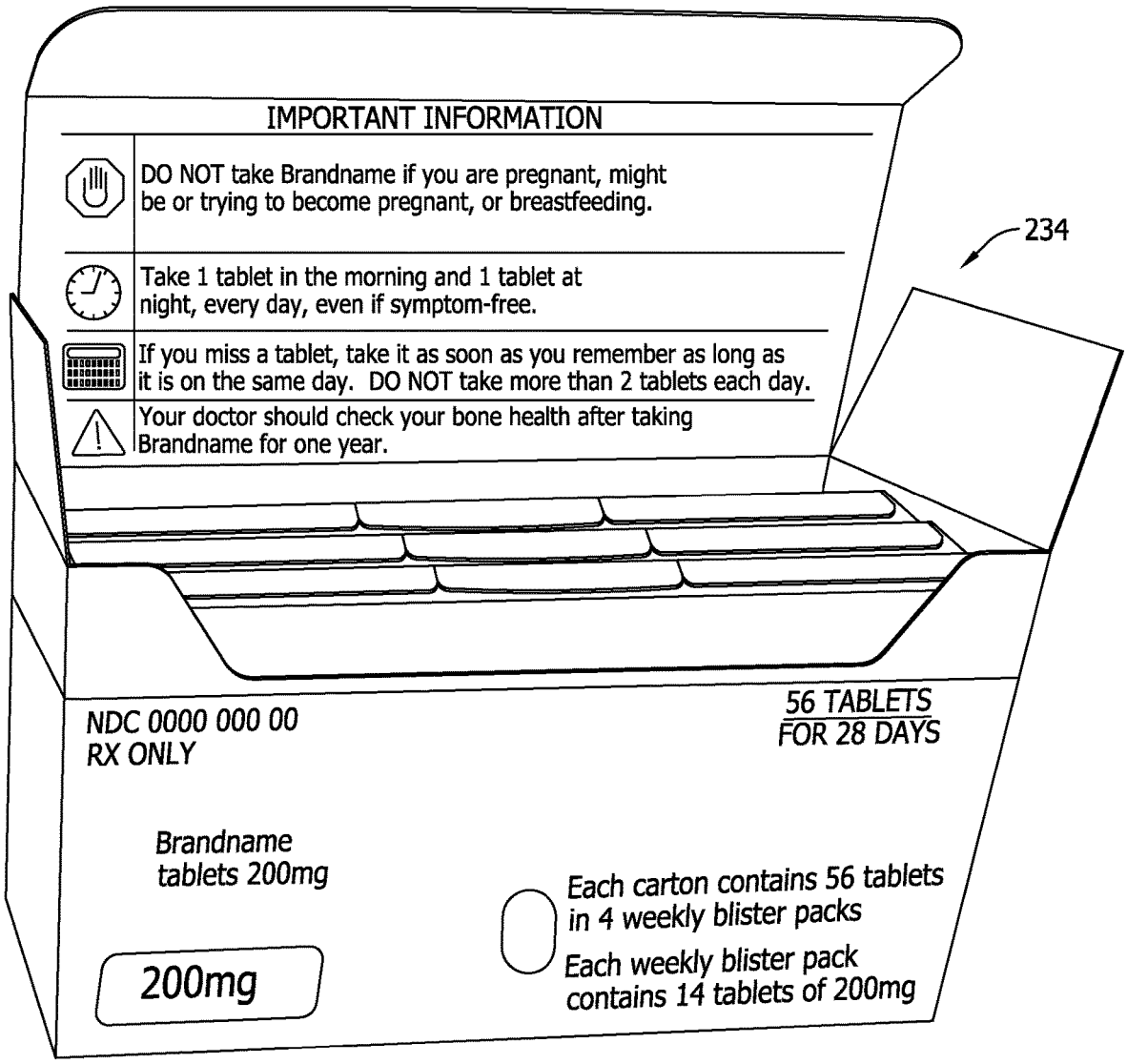
FIG. 21 is a perspective view of an alternative overpack carton for storing and transporting multiple child-resistant medication container assemblies.
Figure 22:
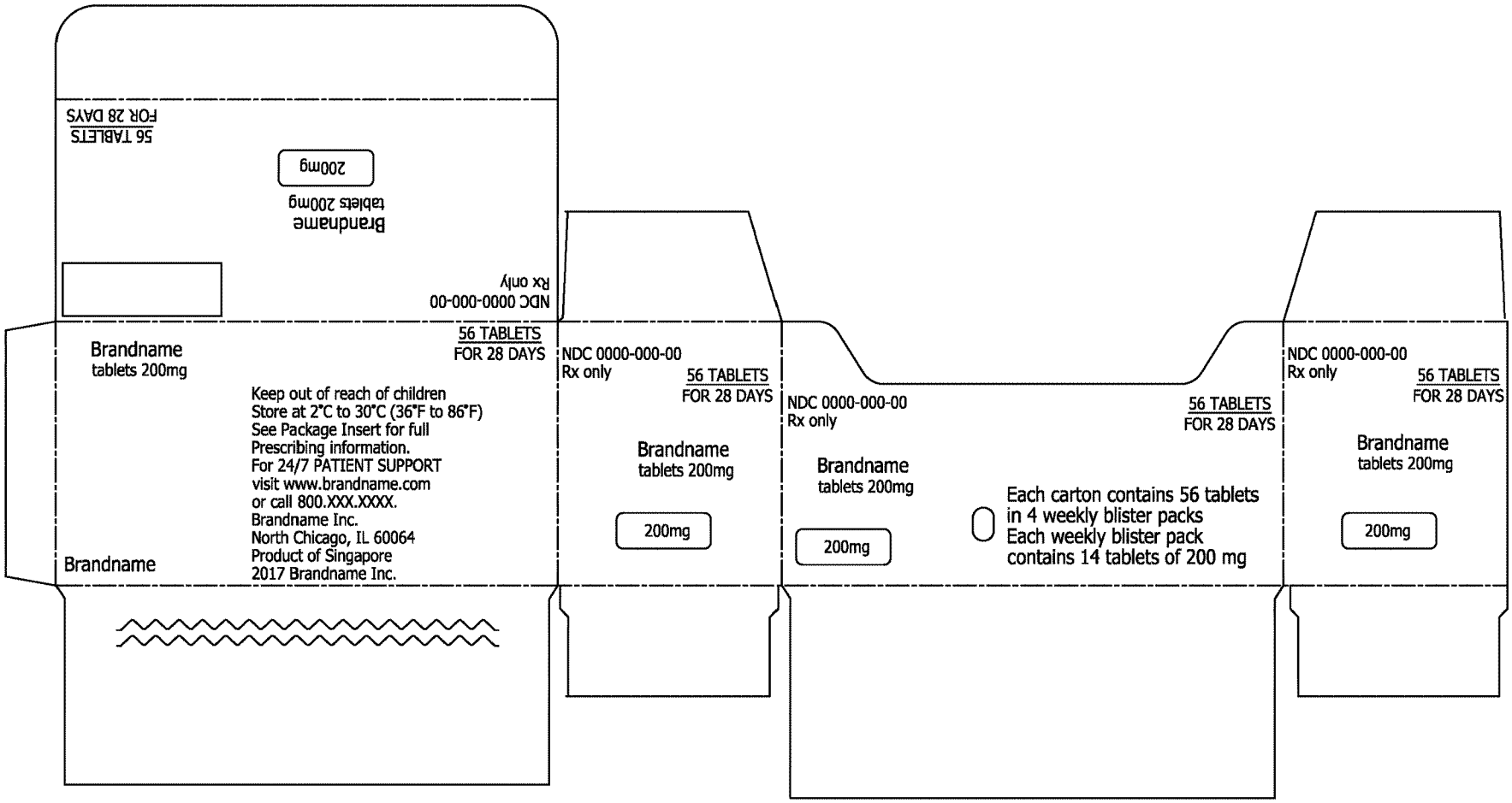
FIG. 22 is a top plan view of an example blank of sheet material for forming the overpack carton shown in FIG. 21.
Figure 23:
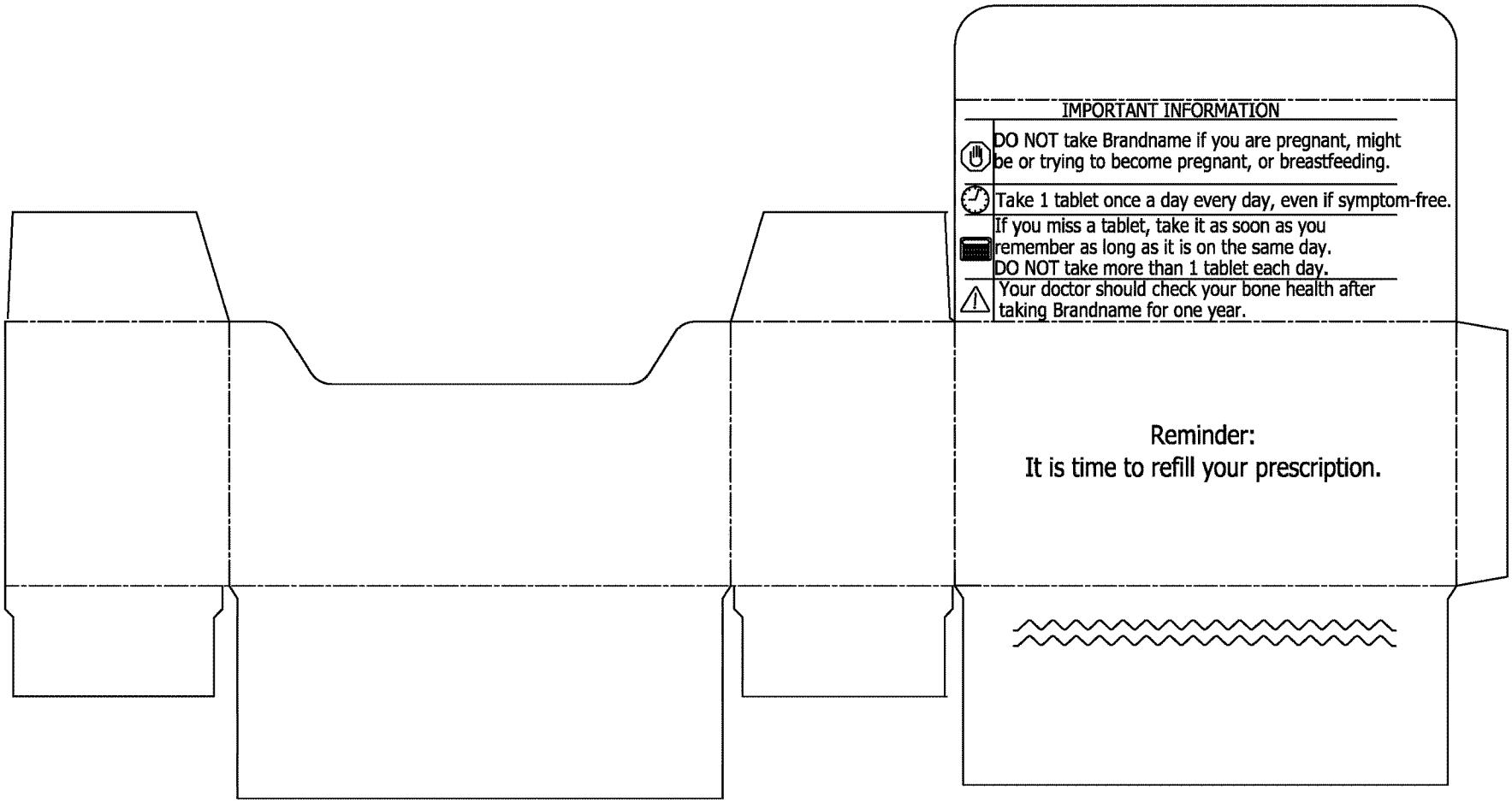
FIG. 23 is a bottom plan view of the blank of sheet material shown in FIG. 22.

Referring to FIGS. 19 and 20, a blank 270 of sheet material for forming a carton 272 of container assembly 232 (both shown in FIGS. 13 and 14) is illustrated. In the example embodiment, blank 270 includes first wall 268 and a second wall 274. Second wall 274 includes a plurality of perforations 276 defined therein. More specifically, the plurality of perforations 276 are arranged in a pair of rows to correspond to the arrangement of the plurality of compartments 258 of blister card 240 (both shown in FIG. 18). Thus, when carton 272 is formed, first wall 268 is opposite second wall 274, and each perforation 276 corresponds to one of the plurality of compartments 258 in blister card 240.

This written description uses examples to disclose various implementations, including the best mode, and also to enable any person skilled in the art to practice the various implementations, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A child-resistant medication container assembly comprising:

a blister card comprising a plurality of compartments each configured to support a dosage of medication;

a puck comprising a body portion, a recess partially defined by a partition wall in the body portion, and a plurality of openings defined in the partition wall, wherein each opening corresponds to one of the plurality of compartments in the blister card;

a label insert positioned within the recess, a plurality of openings defined in the label insert, each opening in the label insert corresponding to one of the plurality of compartments in the blister card and to one of the plurality of openings in the partition wall; and a carton comprising a first wall opposite a second wall, wherein an access opening is defined in the first wall and a plurality of perforations are defined in the second wall, the access opening sized to provide access to the plurality of compartments, and each perforation corresponding to one of the plurality of compartments in the blister card.

2. The assembly in accordance with claim 1, wherein the access opening is shaped to correspond to an upper perimeter of the recess.

3. The assembly in accordance with claim 2, wherein the access opening comprises an inner side edge that defines a frame about the plurality of compartments.

4. The assembly in accordance with claim 1, wherein the carton further comprises a third wall rotatable relative to the first wall such that access to the plurality of compartments through the access opening is restricted when the third wall is in a closed position.

5. The assembly in accordance with claim 4, wherein the access opening is defined by a removable panel adhered to the third wall, the removable panel initially secured to the first wall when the third wall is in the closed position.

6. The assembly in accordance with claim 5, wherein the removable panel is initially secured to the first wall with a plurality of connector tabs disposed about a periphery of the access opening.

7. The assembly in accordance with claim 5, wherein the removable panel includes information related to administration of the medication.

8. The assembly in accordance with claim 1, wherein the number of compartments in the blister card is a multiple of the number of days in a week.

9. The assembly in accordance with claim 1, wherein the dosage of medication secured in each of the plurality of compartments is accessible by puncturing a seal in the blister card.

10. The assembly in accordance with claim 1, wherein the recess has a depth that is greater than a height of the plurality of compartments such that the plurality of compartments is positioned a distance below the first wall.

11. A method of assembling a child-resistant medication container assembly, the method comprising:

aligning a blister card, including a plurality of compartments each configured to support a dosage of medication, with a puck that includes a body portion, a recess that defines a partition wall in the body portion, and a plurality of openings defined in the partition wall, wherein each opening corresponds to one of the plurality of compartments in the blister card when the blister card is aligned with the puck;

attaching the blister card to the puck to form a puck assembly;

positioning a label insert within the recess, a plurality of openings being defined in the label insert, each opening in the label insert corresponding to one of the plurality of compartments in the blister card and to one of the plurality of openings in the partition wall;

positioning the puck assembly within a carton that includes a first wall opposite a second wall, wherein an access opening is defined in the first wall and a plurality of perforations are defined in the second wall, the access opening sized to provide access to the plurality of compartments, and each perforation corresponding to one of the plurality of compartments in the blister card; and closing the carton to enclose the puck assembly therein.

12. The method in accordance with claim 11, wherein positioning the puck assembly comprises aligning the puck with the first wall such that the access opening corresponds to an upper perimeter of the recess.

13. The method in accordance with claim 11 further comprising forming the carton from the first wall, the second wall, and a third wall overlaying the first wall, the third wall rotatable relative to the first wall such that access to the plurality of compartments through the access opening is restricted when the third wall is in a closed position.

14. The method in accordance with claim 13, wherein forming the carton comprises adhering the third wall to a removable panel of the first wall, the removable panel initially secured to the first wall when the third wall is in the closed position, and the removable panel defining the access opening when the third wall is rotated into an open position.

15. The method in accordance with claim 14 further comprising printing information related to administration of the medication on the removable panel.

16. A method of dispensing medication secured within a child-resistant medication container assembly to a user, the method comprising:

providing the child-resistant medication container assembly including a carton, a puck, a blister card, and a label insert, wherein the label insert is positioned within a recess on the puck, the blister card is secured to the puck and the puck is secured to the carton;

applying a force to at least one compartment of a plurality of compartments of the blister card, wherein the plurality of compartments are accessible through an access opening in a first wall of the carton, and wherein the label insert includes a plurality of openings each opening in the label insert corresponding to one of the plurality of compartments in the blister card; and breaking a seal of the at least one compartment such that a dosage of medication contained therein is discharged through an opening in the puck and through an opening in a second wall of the carton, the opening in the second wall of the carton defined by a perforation in the second wall.

17. The method in accordance with claim 16, wherein the first wall is opposite the second wall, and the carton further includes a third wall overlaying the first wall when in a closed position, the method further comprising rotating the third wall relative to the first wall to provide access to the plurality of compartments through the access opening.

18. The method in accordance with claim 17, wherein the first wall further includes a removable panel initially secured thereto and that is also adhered to the third wall, wherein rotating the third wall comprises breaking a connection between the first wall and the removable panel such that the removable panel defines the access opening when the third wall is rotated into an open position.

19. The assembly in accordance with claim 1, wherein the label insert includes indicia instructing a user of the assembly in the administration of the medication.

20. The method in accordance with claim 11, wherein the label insert includes indicia that instructs a user of the medication in the administration of the medication.

* * * * *